US006374075B1

(12) United States Patent
Benedict et al.

(10) Patent No.: US 6,374,075 B1
(45) Date of Patent: Apr. 16, 2002

(54) PRINTING SYSTEMS AND METHODS

(75) Inventors: Lawrence R. Benedict, Fairport; Joannes N. M. DeJong, Suffern; Vittorio R. Castelli, Yorktown Heights; Lloyd A. Williams, Mahopac; Vincent M. Williams, Palmyra, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/559,734

(22) Filed: Apr. 28, 2000

(51) Int. Cl.[7] ..... G03G 15/00
(52) U.S. Cl. ..... 399/395; 399/394
(58) Field of Search ..... 399/388, 389, 399/394, 395, 396; 271/226, 227, 228, 234

(56) References Cited

U.S. PATENT DOCUMENTS 5,078,384 A * 1/1992 Moore ..... 271/228
5,278,624 A * 1/1994 Kamprath et al. ..... 399/395
5,652,943 A * 7/1997 Matsuo et al. ..... 399/389 X
5,678,159 A * 10/1997 Williams et al. ..... 399/395
5,697,608 A * 12/1997 Castelli et al. ..... 271/228
5,697,609 A * 12/1997 Williams et al. ..... 271/228
5,731,680 A * 3/1998 Winterberger et al. .. 399/396 X
5,794,176 A * 8/1998 Milillo ..... 399/395 X
5,887,996 A * 3/1999 Castelli et al. ..... 271/227 X
6,014,542 A * 1/2000 Hozumi et al. ..... 399/394
6,208,831 B1 * 3/2001 Amano ..... 399/396

* cited by examiner

*Primary Examiner*—Sandra Brase
(74) *Attorney, Agent, or Firm*—McIntyre Harbin & King

(57) ABSTRACT

A copy machine having a high accuracy sheet registration system for precise placement of images on each copy sheet. The copy machine includes sensors with charge coupled devices (CCDs) that detect the sheet positions in two dimensions within the machine, and detect sheet arrival times at various positions with the machine. Using this detected information, the copy machine employs a multi-stage process to bring the sheet into contact with a color image moving on a photoreceptor belt, in synchronism with the position and speed of the image on the belt. The copy machine also monitors its own condition and makes predictions about needed preventive maintenance, to instruct personnel to service the machine before the machine fails.

36 Claims, 22 Drawing Sheets

Fig. 3 Sample Reg rolls velocity profile

Fig.10 Reg. Nip Release Time/Displacement Graph

PRINTING SYSTEMS AND METHODS

BACKGROUND OF THE INVENTION

This invention relates generally to a printing system and method and, more particularly, to systems and methods for positioning a copy sheet in an image reproduction system.

High quality document production in a printing system may depend, in part, upon precise placement of an image on a copy sheet. Such precise placement typically relies on a process of positioning the copy sheet in the printing system.

The following documents may be relevant to the instant disclosure: U.S. Pat. Nos. 5,678,159;5,697,608; 5,697,609; 5,555,084; 5,794,176; 5,715,514; 5,273,274; 4,438,917; 4,511,242; 4,519,700; 4,877,234;4,971,304; 5,078,384; 5,094,442; and 5,156,391.

SUMMARY OF THE INVENTION

It is an object of the present invention to provide a system and method related to positioning a copy sheet in a document reproduction system.

To achieve this and other objects of the present invention, there is a method in a system including a moving substrate for holding an image, and a path to the substrate. The method comprises the steps, performed for each of a plurality of sheets, of comprises sending the sheet into the path; adjusting a position of the sheet by applying a first force to the sheet from a first position along the path; and applying a second force to the sheet from a second position along the path, the second force being a function of speeds of the substrate and the sheet.

According to another aspect of the present inventing a system comprises a movable substrate for holding an image; a path to the substrate; a first adjuster that adjusts a position of a sheet by applying a first force to the sheet from a first position along the path; and a second adjuster that adjusts the sheet by applying a second force to the sheet from a second position along the path, the second force being a function of speeds of the substrate and the sheet.

According to yet another aspect of the present invention, there is a registration system in a first system including a movable substrate for holding an image, and a path to the substrate. The registration system comprises means for sending a sheet into the path; means for adjusting a position of the sheet by applying a first force to the sheet from a first position along the path; and means for adjusting a speed of the sheet by applying a second force to the sheet from a second position along the path, the second force being a function of speeds of the substrate and the sheet.

According to yet another aspect of the present invention, there is a method in a system including a moving substrate for holding an image, and a path to the substrate. The method comprises sending a sheet into the path; and applying a force to the sheet to propel the sheet along the path at a controlled speed, the force being a decreasing function of time in response to a position of the sheet.

According to yet another aspect of the present invention, a system comprises a movable substrate for holding an image; a path to the substrate; an adjuster that applies a force to the sheet to propel the sheet along the path at a controlled speed, the force being a decreasing function of time in response to a position of the sheet.

According to yet another aspect of the present invention, there is a registration system in a system including a movable substrate for holding an image, and a path to the substrate. The registration system comprises means for sending a sheet into the path; and means for applying a force to the sheet to propel the sheet along the path at a controlled speed, the force being a decreasing function of time in response to a position of the sheet.

According to yet another aspect of the present invention, there is a method in a system including a moving substrate for holding an image, and a path to the substrate, first actuator in the path, a second actuator in the path, and a third actuator in the path. The method comprises sending a first sheet into the path; sending a second sheet into the path; adjusting a position of the first sheet by applying a first force from the first actuator while applying a force, different from the first force, from the second actuator; and adjusting a position of the second sheet by applying a second force from the first actuator while applying a force, different from the second force, from the third actuator.

According to yet another aspect of the present invention, a system comprises a movable substrate for holding an image; a path to the substrate; a first actuator in the path; a second actuator in the path; a third actuator in the path, the first, second, and third actuators defining an orientation transverse to a direction of the path an adjuster configured to a position of a first sheet by applying a first force from the first actuator while applying a force, different from the first force, from the second actuator, and to adjust a position of a second sheet by applying a second force from the first actuator while applying a force, different from the second force, from the third actuator.

According to yet another aspect of the present invention, there is a registration system in a system including a movable substrate for holding an image, and a path to the substrate, first actuator in the path, a second actuator in the path, and a third actuator in the path. The registration system comprises means for sending a first sheet into the path; means for sending a second sheet into the path; means for adjusting a position of the first sheet by applying a first force from the first actuator while applying a force, different from the first force, from the second actuator; and means for adjusting a position of the second sheet by applying a second force from the first actuator while applying a force, different from the second force, from the third actuator.

According to yet another aspect of the present invention, there is a method in a system including a moving substrate for holding an image, and a path to the substrate, first actuator in the path, a second actuator in the path, and a third actuator in the path. The method comprises sending a sheet into the path, such that a first edge of the sheet has a first position relative to a second edge of the sheet; detecting the first edge at a first time; applying a first force to the sheet, the first force being a function of the first time; resending the sheet into the path, such that the first edge has a second position relative to the second edge, the second position being opposite the first position; detecting the first edge at a second time; applying a second force to the sheet, the second force being a function of the second time.

According to yet another aspect of the present invention, there is a system that processes a sheet having a first edge and a second edge opposite the first edge. The system comprises a detector that generates a first signal in response to detection of the first edge at a first time and generates a second signal in response to detection of the first edge at a second time; and a pigment applicator operative between the first and second times.

According to yet another aspect of the present invention, there is a registration system in a first system including a movable substrate for holding an image, and a path to the substrate, first actuator in the path, a second actuator in the path, and a third actuator in the path. The registration system comprises means for sending a medium into the path, such that the first edge has a first position relative to the second edge; means for detecting the first edge at a first time; means for applying a first force to the medium, the first force being a function of the first time; means for resending the medium into the path, such that the first edge has a second position relative to the second edge, the second position being opposite the first position; means for detecting the first edge at a second time; means for applying a second force to the medium, the second force being a function of the second time.

According to yet another aspect of the present invention, there is a method in a printing system. The method comprises detecting a process of the printing system; storing a first signal in response to the detecting step; printing images during a plurality of weeks; subsequently, detecting the process of the printing system to generate a second signal; comparing, responsive to the first and second signals, to generate a third signal; and selectively displaying a condition of the printing system, responsive to the third signal.

According to yet another aspect of the present invention, a printing system comprises a recorder that records a first signal in response to the detecting a process in the printing system; printing images; a detector that detects the process of the printing system to generate a second signal; a comparator, responsive to the first and second signals, that generates a third signal; and a display that receives the third signal.

According to yet another aspect of the present invention, there is a method in a system including a substrate for holding an image, a path toward the substrate, a moving member configured to propel a sheet along the path, and a generator that generates signals in accordance with movement of the member. The method comprises selectively generating a visual signal depending on whether the rate of change of a number of encoder pulses, per unit time, is above a threshold.

The accompanying drawings which are incorporated in and which constitute a part of this specification, illustrate embodiments of the invention and, together with the description, explain the principles and advantages of the invention. Throughout the drawings, corresponding parts are labeled with corresponding reference numbers.

DESCRIPTION OF THE PREFERRED EMBODIMENTS

Figure 1:
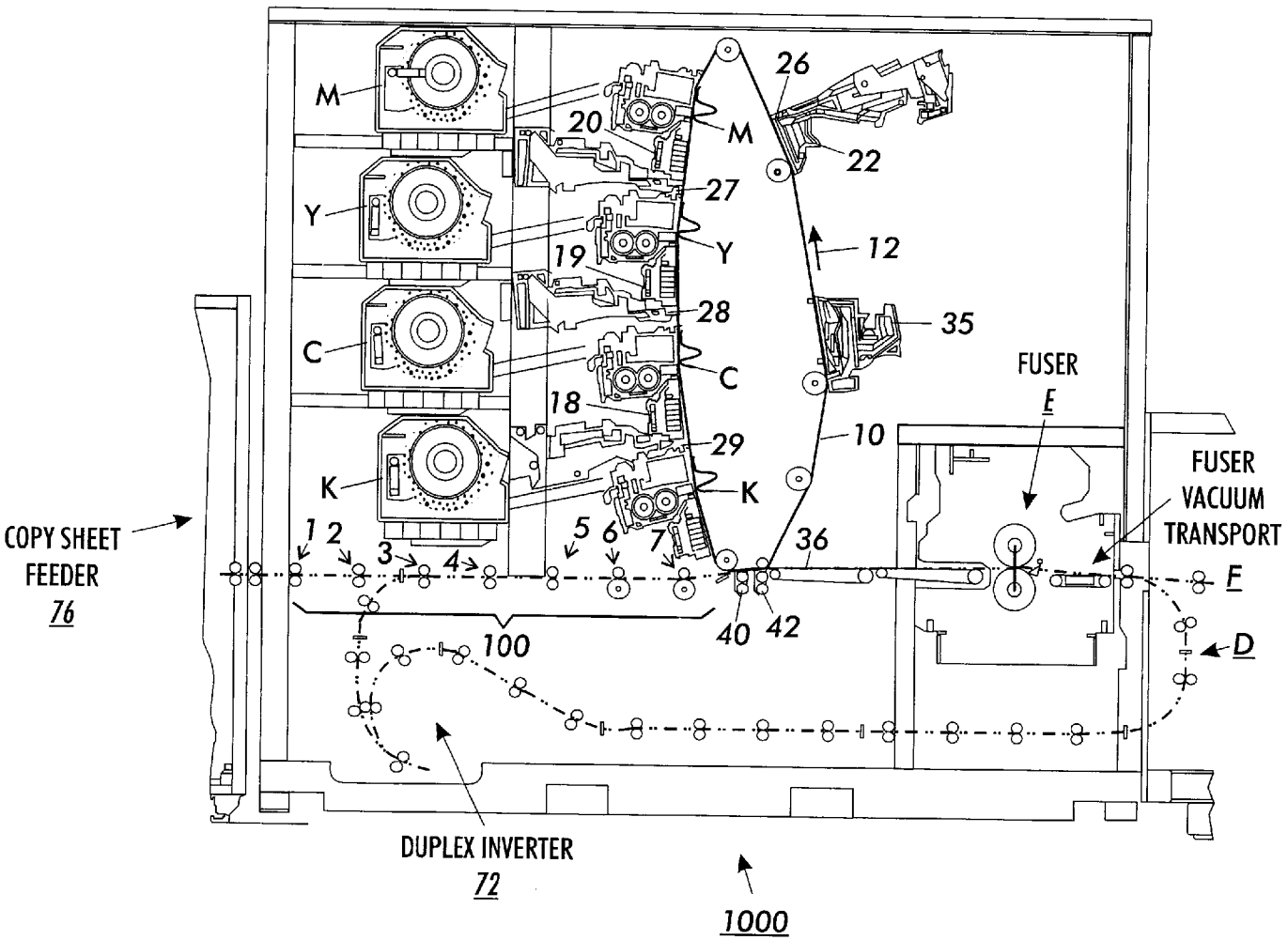
FIG. 1 is a side view of a preferred image reproduction system.

FIG. 1 shows printing apparatus 1000 including copy sheet registration system100 according to a preferred embodiment of the present invention. Photoreceptor belt 10 advances in the direction of arrow 12 through the various processing stations around the path of belt 10. Charger 22 charges an area of belt 10 to a relatively high, substantially uniform potential. Next, the charged area of belt 10 passes laser 26 to expose selected areas of belt 10 to a pattern of light, to discharge selected areas to produce an electrostatic latent image. Next, the illuminated area of the belt passes developer unit M, which deposits magenta toner on charged areas of the belt.

Subsequently, charger 20 charges the area of belt 10 to a relatively high, substantially uniform potential. Next, the charged area of belt 10 passes laser 27 to expose selected areas of belt 10 to a pattern of light, to discharge selected areas to produce an electrostatic latent image. Next, the illuminated area of the belt passes developer unit Y, which deposits yellow toner on charged areas of the belt.

Subsequently, charger 19 charges the area of belt 10 to a relatively high, substantially uniform potential. Next, the charged area of belt 10 passes laser 28 to expose selected areas of belt 10 to a pattern of light, to discharge selected areas to produce an electrostatic latent image. Next, the illuminated area of the belt passes developer unit C, which deposits cyan toner on charged areas of the belt.

Subsequently, charger 18 charges the area of belt 10 to a relatively high, substantially uniform potential. Next, the charged area of belt 10 passes laser 29 to expose selected areas of belt 10 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 10. In synchronism with the movement of the image on belt 10, registration system 100 brings a copy sheet into contact with the image on belt 10. Registration system 100 receives the sheet via high capacity sheet feeder 76 or via duplex sheet inverter 72. Registration system 100 is subsequently described in more detail.

A corotron 40 charges the sheet, from sheet registration system 100, to tack the sheet to belt 10 and to move the toner from belt 10 to the sheet. Subsequently, detack corotron 42 charges the sheet to an opposite polarity to detack the sheet from belt 10. Prefuser transport 36 moves the sheet to fuser E, which permanently affixes the toner to the sheet with heat and pressure. The sheet then advances to output section F, or to duplex loop D.

Cleaner 35 removes toner that may remain on the image area of belt 10.

In order to complete duplex copying, duplex loop D feeds sheets back to registration system 100 via various rollers for transfer of a toner powder image to the opposed sides of the copy sheets. Duplex inverter 72, in duplex loop D, inverts the sheet such that what was the top face of the sheet, on the previous pass through system 100, will be the bottom face on the sheet, on the next pass through system 100. Duplex inverter 72 inverts the sheet such that what was the leading edge of the sheet, on the previous pass through system 100, will be the trailing on the sheet, on the next pass through system 100.

Figure 2:
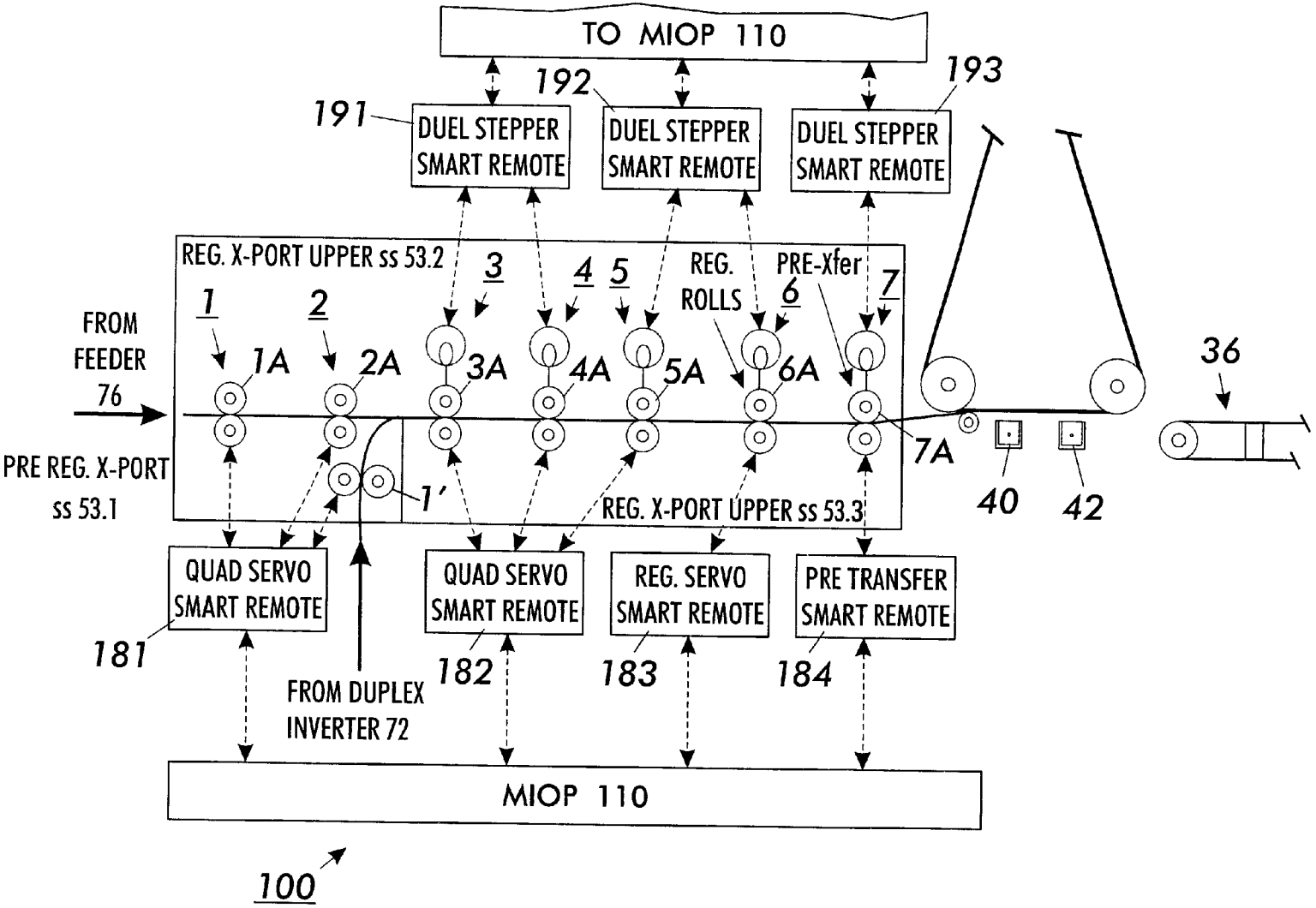
FIG. 2 is a diagram emphasizing a copy sheet registration system in the system of FIG. 1.
Figure 3:
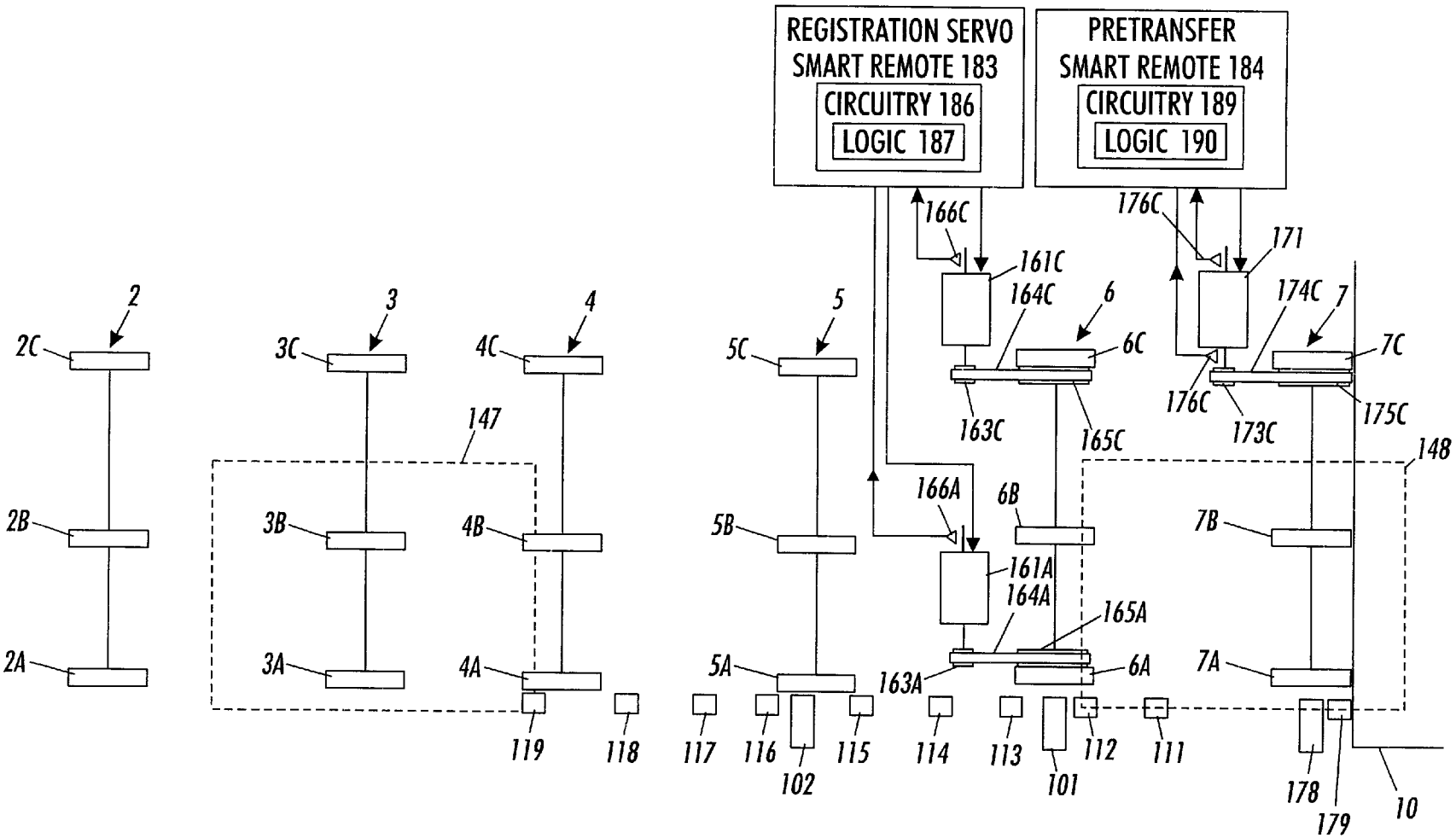
FIG. 3 is a diagram emphasizing a portion of the copy registration system shown in FIG. 2.

FIG. 2 is a side view and FIG. 3 is a plan view showing registration system 100 in more detail, including three stepper driver boards 191, 192, and 193 that control stepper nip releases, and quad servo smart remotes 181 and 182 that control constant velocity motors. These boards are mounted on the back of the machine.

System 100 includes eight sheet transport stations. Each transport station includes three rubber drive rollers and corresponding idler rollers over each drive roller. Stations 1, 1', 2, 3, 4, and 5 drive at a constant 1024 mm/sec under control of a quad servo board with on and off commands from central controller (MIOP) 110. Stations 1, 1' and 2, are powered by a constant velocity brushless DC servo motor. Stations 3, 4, 5, are powered by another constant velocity brushless DC servo motor.

FIG. 3 shows sensors 119, 118, 117, 116, 102, 115,114, 113, 101, 112, 111, 178, and 179 for determining the position and orientation of a copy sheet as the sheet moves through the transport stations. Each of process edge sensors 119, 118, 117, 116, 115, 114, 113, 112, 111, and 179 generates a binary signal to indicate whether a sheet is covering the sensor. Thus, these process edge sensors allow the circuitry in system 100 to determine the longitudinal position and speed of sheets.

Process edge sensors 102, 101, and 178 each include a 2048×1 CCD (charge coupled device) array for measuring the lateral position of a sheet.

Transport station 3 includes rollers 3A, 3B, and 3C. Subsequent, downstream, transport station 4 includes rollers 4A, 4B, and 4C. Subsequent transport station 5 includes rollers 5A, 5B, and 5C. Subsequent transport station 6 includes rollers 6A, 6B, and 6C. Subsequent transport station 7 includes rollers 7A, 7B, and 7C.

Transport station 6 also includes variable speed, pulse-width-modulated, servo motor 161A that drives roller 6A via motor pulley 163A, belt 164A, and registration shaft 165A. Shaft encoder 166A sends signals to registration servo smart remote 183, which is on a circuit board mounted on a back plane of system 100. Remote 183 includes a memory, instruction in the memory, and a general purpose processor that executes the instructions. Remote 183 includes circuitry 186 having logic 187 that receives signals from encoders 166A and 166C, and generates respective pulse-width-modulated drive signals for each of motors 161A and 161C. In this Disclosure, the term circuitry encompasses both dedicated hardware and programmable hardware, such as a CPU or reconfigurable logic array, in combination with programming data, such as sequentially fetched CPU instructions or programming data for a reconfigurable array.

Smart remote 183 sends pulse-width-modulated signals to servo motor 161A, in response to signals from encoder 166A, and sheet sensors 119, 118, 117, 116, 102, 115,114, 113, 101, 112, 111, 178, and 179.

Transport station 6 also includes variable speed, pulse-width-modulated servo motor 161C that drives roller 6C, or roller 6B, via motor pulley 163C, belt 164C, and registration shaft 165C.

Shaft encoder 166C sends signals to registration servo smart remote 183. Smart remote 183 sends pulse-width-modulated signals to servo motor 161C, in response to signals from encoder 166C and sheet sensors 119, 118, 117, 116, 102, 115,114, 113, 101, 112, 111, 178, and 179.

Transport station 7 also includes variable speed, pulse-width-modulated servo motor 171 that drives rollers 7A, 7B, and 7C; via motor pulley 173C, belt 174C, and registration shaft 175A.

Shaft encoder 176C sends signals to pre-transfer smart remote 184, which is on a circuit board mounted on a back plane of preferred system 100. Remote 184 includes a memory, instruction in the memory, and a general purpose processor that executes the instructions. Remote 184 includes circuitry 189 having logic 190 that receives a signal from encoder 176C, and response, generates a pulse-width-modulated control signal for motor 171.

In response to signals from encoder 176C, smart remote 184 sends pulse-width-modulated signals to servo motor 171.

A principal function of transport station 7 is to provide a fine adjustment of the sheet to the image on belt 10, and to the speed of belt 10. For side one, station 7 performs this adjustment responsive to detection of the leading edge of the sheet. On side two, of duplex sheets, station 7 performs this adjustment responsive to detection of the trail edge of the sheet. Remote 184 selects which sensors to use for this edge detection, depending on the sheet size.

Transport stations 3 to 7 each have a cam and stepper motor mechanism on their idlers to release the drive of their nips. MIOP 110 activates the stepper motors for transport stations 3, 4, and 5 at the start of sheet registration, using a control pattern dependent on sheet size, by timing the leading or trailing edge of a sheet as it passes various process edge sensor. The stepper motor closes the nip making it ready to receive the next sheet, as soon as the trail edge of the sheet leaves each station, as determined by a predetermined time past the trail edge leaving various process edge sensors.

Figure 4A:
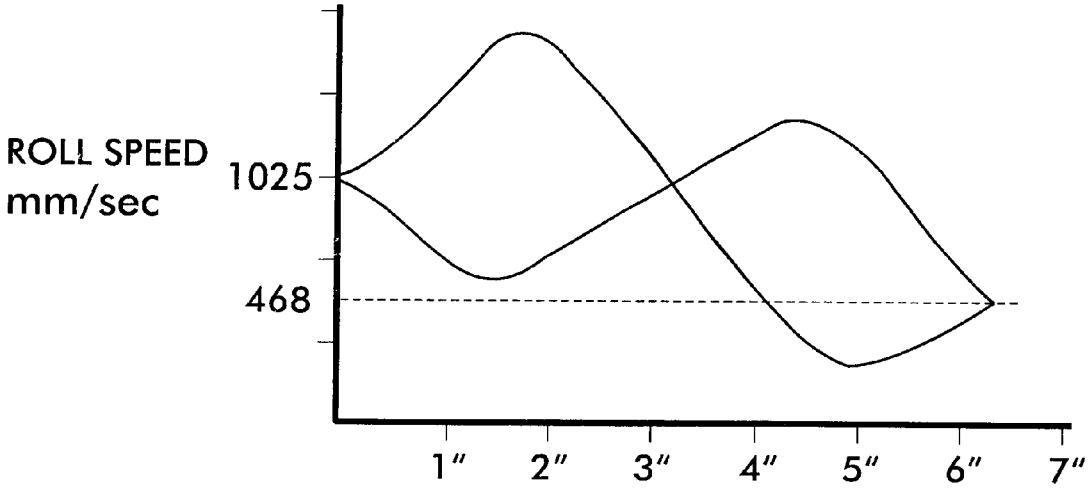
FIGS. 4A and 4B are diagrams used for describing an operation of the preferred registration system.
Figure 4B:
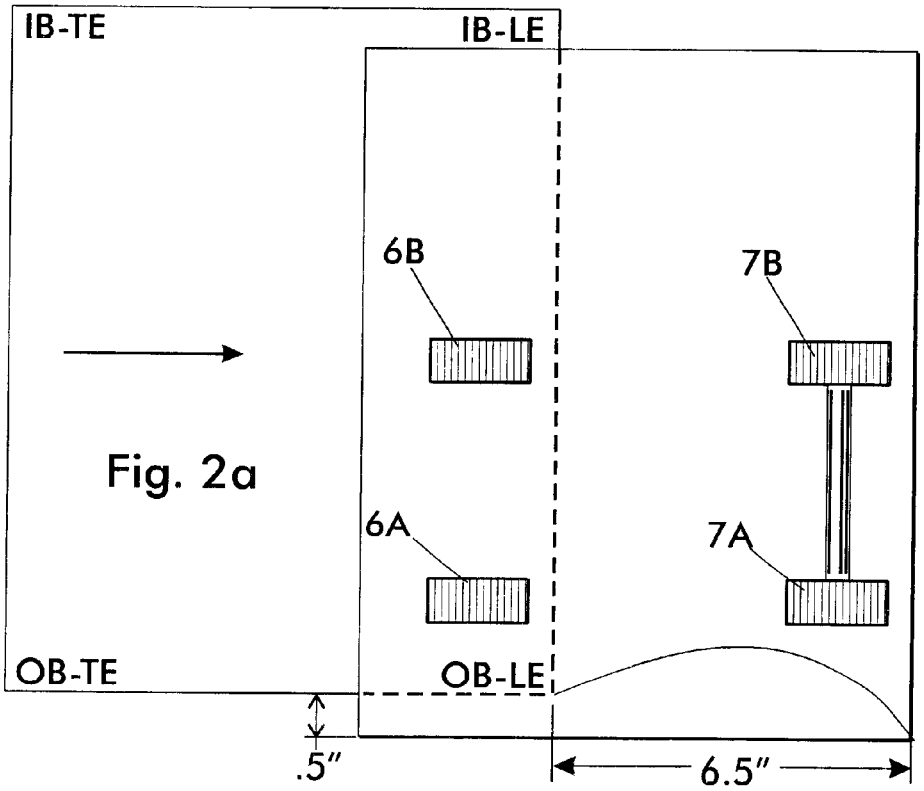

FIGS. 4A and 4B show an operation of registration system 100. Remote 183 starts sheet registration when a sheet leading edge has proceeded 19 mm beyond the centerline of transport station 6. This distance, 19 mm, allows for sheet skew, stepper motor, and software response.

Each of rollers 6A and 6B is powered by a respective independent servo motor; roller 6A is powered by servo motor 161A and roller 6B is powered by servo motor 161C. Remote 183 deskews a sheet by varying the speed of these rollers 6A and 6B relative to each other. Remote 183 corrects sheet timing, in the process direction, by changing the average speed of the rollers 6A and 6B.

Remote 183 performs inboard and outboard sheet movement by skewing the sheet for a period of time then straightening the sheet out when the desired inboard (IB) to outboard (OB) offset has been achieved. As shown in FIGS. 4A and 4B, the sheet enters registration rollers 6A and 6B with a certain amount of IB to OB offset, 0.5" of IB offset in this example. Once the sheet enters rollers 6A and 6B, roller 6A is sped up and roller 6B is slowed down, causing the sheet to rotate counter clockwise. After a certain period of time roller 6A is slowed down and roller 6B is sped up to straighten the sheet back out. This entire operation is performed within a period before traversal of the 6.5" distance to transport station 7. The IB to OB registration is corrected during this distance, as well as the sheet leading edge (LE) to trail edge (TE) registration, skew and sheet slowdown. As shown in the example of FIG. 4A, the sheet enters transport station 6 rollers at 1025 mm/sec and leaves transport station 6 at 468 mm/sec.

Smart remote 183 includes circuitry 186 to mathematically derive the velocity profile for both roller 6A and roller 6B. Basically, circuitry 186 is responsive to the position, speed and orientation of the sheet when it enters rollers 6A and 6B, and to the desired position, speed and orientation of the sheet when it is to enter transfer transport station 7, along with the available time for correction. Thus, circuitry 186 calculates the roller velocity profile.

Sensor 112 generates a signal when a sheet leading edge has proceeded 19 mm beyond the axis of rollers 6A, 6B, and 6C. In response to the signal from sensor 112, remote 183 generates a pulse-width-modulated control signal for motor 161C, to apply correction force from roller 6C to the sheet. Circuitry 186 controls the motor 161C drive signal to cause roller 6C to cease to apply the correction force at a time when roller 6C has completed a substantially integer number of revolutions. It is presently preferred that the integer number of revolutions be substantially equal to one.

Once the registration process is complete for lateral position and skew, the sheet enters transport station 7. When the sheet enters 19 mm into the axis of roller 7A, 7B, and 7C, the sheet trips edge sensor 179, causing remote 184 to do a final process correction by varying the speed of motor 171.

System 100 performs sheet adjustments relative to a registration sync (reg sync) pulse sent via a hard wire to remote 183 and remote 184. The registration sync pulse signifies the occurrence of scanning by laser 29.

In the simplex mode, remote 183 uses the CCD lateral sensor 101 and CCD lateral sensor 102 to measure the sheet lateral input position and input skew sheet. After the registration process is complete, remote 183 uses CCD lateral sensor 101 and CCD lateral sensor 178 to check how well it did in reaching the lateral and skew target.

Smart remote 183 uses the process edge sensor 102 to measure the sheet input leading edge position relative to reg sync and the process edge sensor 178 to check how well it did. Due to errors caused by transport station 6 being unable to follow theoretical profile exactly, transport station 6 can only adjust the process registration within a certain tolerance. Thus, transport station 7 performs a final process adjustment to the leading edge of the sheet to bring it within a tighter tolerance.

MIOP 110 sends the speed of photoreceptor belt 10 to remote 183 and remote 184 at the beginning of each job. MIOP 110 also sends the next sheet type to remote 183 and remote 184 when the sheet type is changed. This information is required before the sheet enters transport station 6. The sheet type is used to look up a roller to sheet speed ratio stored in nonvolatile memory in remote 184. The ratio between the speed of the rollers of transport station 7 and the speed of the copy sheet is calculated by counting the encoder pulses, from encoder 176C, between the sheet tripping two trail edge process edge sensors while the sheet is in the rollers of transport station 7. System 100 maintains a table of speed ratios versus sheet type.

Smart remote 184 adjusts speed of the sheet match the speed of belt 10 to within 0.5% before the sheet contacts belt 10. To perform this adjustment, remote 184 is responsive to sheet type, sheet size, photoreceptor speed, image length.

Sheet size, type and side information for the next sheet to be registered is downloaded from a MIOP serial command bus to remote 183. Smart remote 183, using the downloaded numbers, looks up registration target values from its target value table and loads it into RAM.

System 100 is responsive to a selected pair of CCD edge sensors, the selected pair being determined by the sheet size. System 100 takes a snap shot of the sheet position initial conditions, using the edge sensors. This snapshot is the average mechanical edge over a 3 scan (3mm distance). Inboard and outboard nip velocity profiles are computed from where the sheet presently is in position and time relative to where the sheet is expected to end in position and time. The sheet is then moved to this profile. Edge sensors 178 and 101 are used to measure the lateral and skew position of the sheet after registration for feedback for the next sheet. Sensors time stamp the time-of arrival of leading and trailing edges (for side two). Placement of edge sensors is relative to the registration station center line.

In summary, remote 183 adjusts a position of a sheet by applying a first force to the sheet via rollers 6A and 6B, which are located at a first position along the path to belt 10. Remote 184 then applies a second force to the sheet via rollers 7A and 7B, which are located at a second position along the path. The second force is a function of speeds of belt 10 and the sheet.

System 1000 indicates a jam condition by monitoring the presence of sheets in the path to belt 10. During the sheet steering process, the trail edge of a sheet may move through a relatively large band. As a result of steering process, the sensors under sheet may become uncovered briefly, a condition mimicking false arrival of a next sheet. A procedure disables jam detection during steering to prevent errors generated if the paper should make and break these sensors during steering. In other words, station 6 adjusts a position of the sheets by applying a force to the sheets. System 1000 performs this indication in synchronism with the adjusting performed by station 6.

Figure 5:
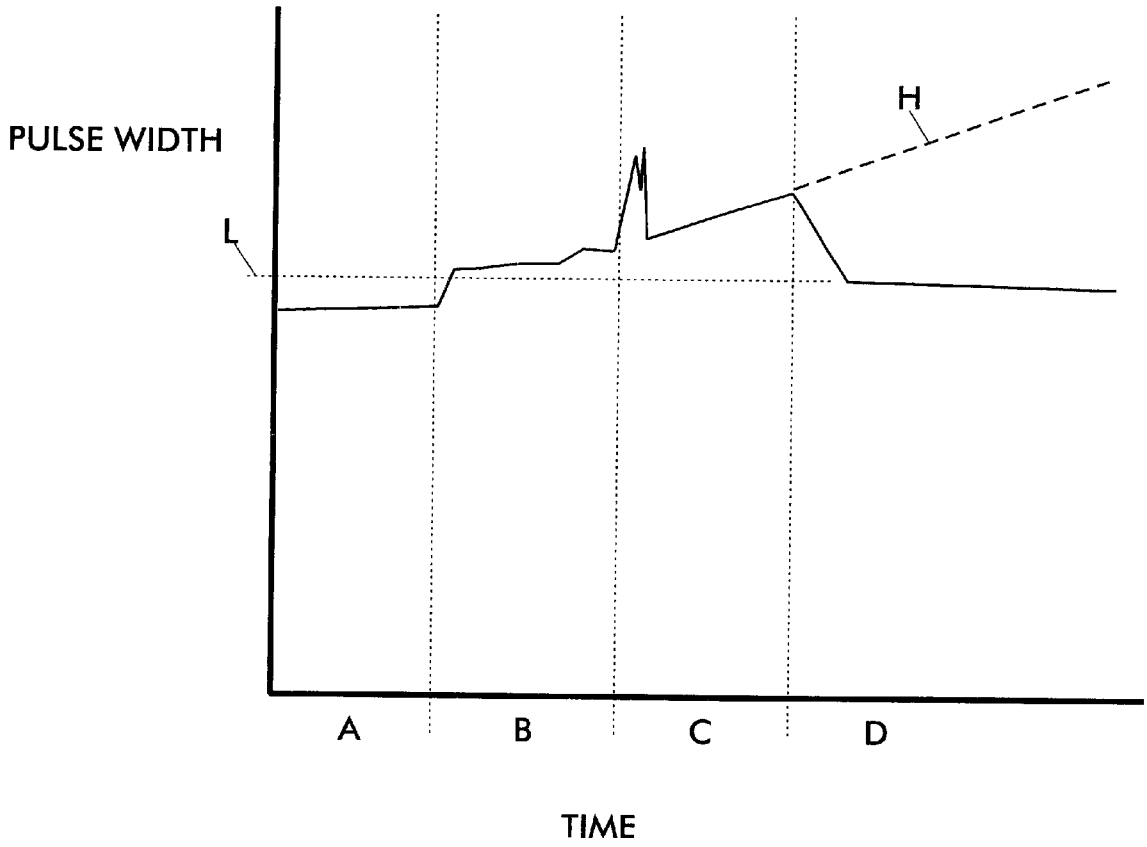
FIG. 5 is a diagram used for describing a signal generated in response to a position of a copy sheet.

FIG. 5 shows another operation of registration system 100. When the sheet approaches belt 10, transport station 7 is in a velocity-controlled mode, as represented in zone A of FIG. 5. After the sheet is registered and becomes attached to belt 10, while the sheet is still in rollers 7A, 7B, and 7C, transport station 7 drives rollers 7A, 7B, and 7C in a torque limiting mode to prevent build up of forces against belt 10. Smart remote 184 enters torque limiting mode after the sheet becomes fully tacked to belt 10. In this mode, remote 184 limits the torque level of motor 171 to a previous torque level motor 171 and ignores the sheet velocity. Remote 184 slowly reduces the torque until the torque is at a value equal to the torque required to drive rollers 7A, 7B, and 7C with no sheet by the time the trail edge of the sheet leaves rollers 7A, 7B, and 7C. Smart remote 184 reduces torque before the trail edge leaves the nip to prevent transients in belt 10.

In the example of FIG. 5, the actual speed of belt 10 is slightly slower then the actual speed at which station 7 is set to control the velocity of the copy sheet. Zone A in FIG. 5 represents a time when station 7 is maintaining the sheet velocity with a relatively constant pulse width for the drive signal for motor 171. Zone B represents a time when the sheet enters a bend in the path leading to belt 10, resulting in increased friction and an increased pulse width to motor 171 to maintain the sheet velocity. Zone C represents a time when the sheet contacts belt 10. As shown in zone C, since the belt has a slightly slower speed then the control speed for the sheet, belt 10 acts as a breaking force against which remote 184 applies an increasing pulse width an attempt to maintain a velocity of the sheet.

The transition between zones C and D represents a point where the sheet becomes fully tacked to belt 10 and drive from motor 171 may be redundant. Smart remote 184 then imposes a limit, represented by the horizontal line L, on the motor drive pulse width in zone D. To avoid transients, remote 184 ramps the pulse width down to the limit L.

This torque limiting mode helps to avoid torque spikes and resulting image defect. Without it, because both belt 10 motor 171 are controlled, there could be a relatively large force developed between both subsystems. In FIG. 5, a hypothetical performance without this torque limiting feature is represented by the dotted line labeled H. Without this torque limiting feature, the pulse width might continue to increase after the sheet becomes fully tacked to the belt. In other words, without this torque limiting feature, the circuitry for controlling the sheet velocity would act to fight the belt, resulting in transients in the belt speed as the sheet drive increases and when the sheet drive abruptly ceases after the sheet leaves the last transport.

In other words, remote 184 modulates the pulse width of the control signal for motor 171 to apply a force to the sheet and to propel the sheet toward belt 10.

Duplex Printing

For the duplex mode, the fine registration correction procedure is identical except that a process edge sensor on the sheets trail edge is used, eliminating the influence of sheet length variations on registration accuracy. In order to do this the pretransfer controller is responsive to the image length in addition to the signals required for side one.

For duplex, remote 183 performs as in simplex and the sheet leading edge is adjusted to ±0.2 mm relative to reg sync. Because the sheet is inverted (trail and leading edge interchanged) and because the sheets cut size could be up to ±0.75 mm (Xerox Cut Spec) or ±2 mm (outside vendor cut spec) the sheet must now be adjusted to the sheets trail edge to remove the process error caused by cut size. The pre-transfer nip does this side two correction by monitoring one of the trail edge sensors after the sheet leading edge enters transport station 7. The correct trail edge sensor is selected based on sheet size downloaded to remote 184 before start of correction.

Figure 6:
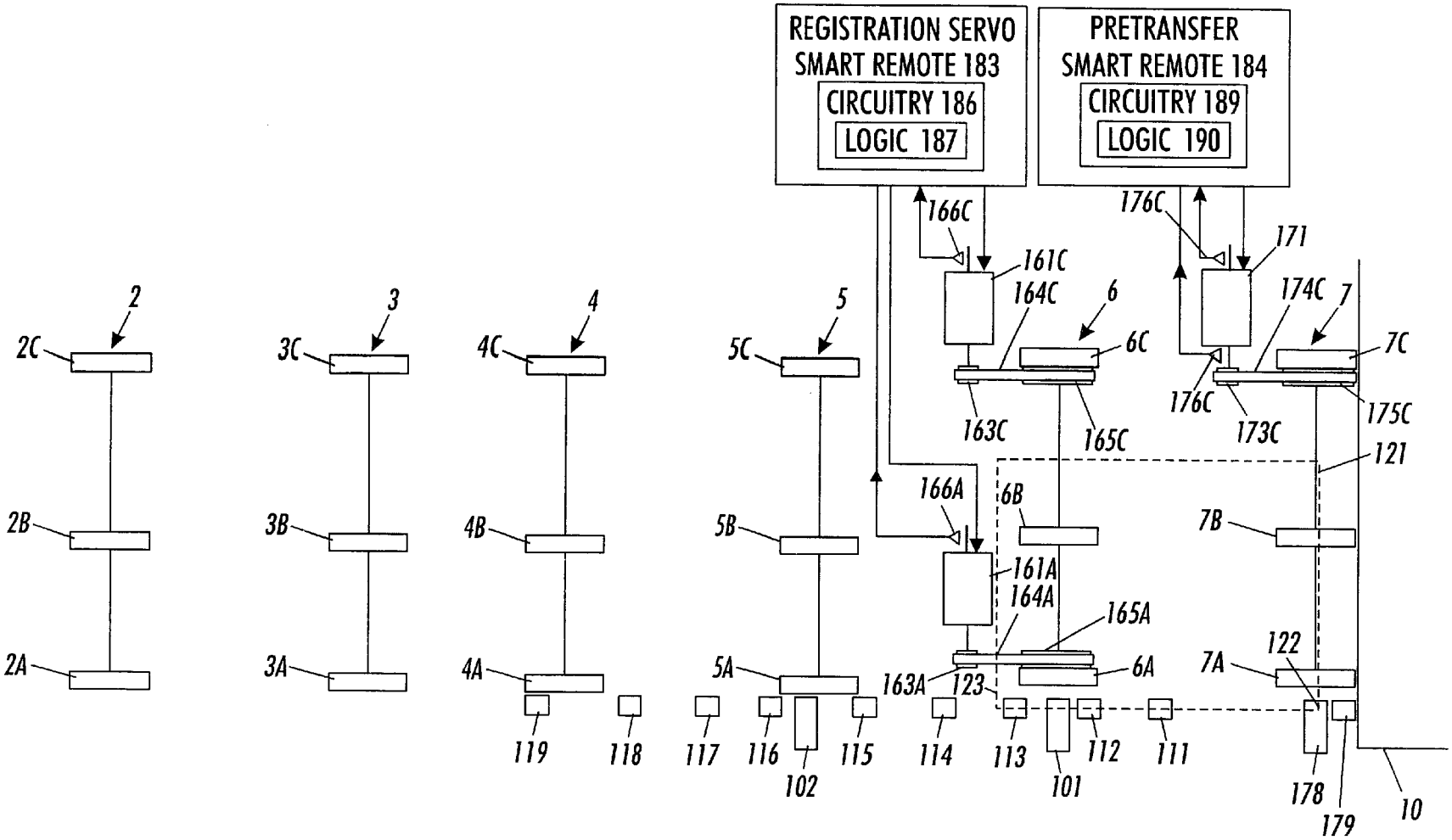
FIG. 6 is a diagram emphasizing the portion of the copy registration system shown in FIG. 3, at a different time.
Figure 7:
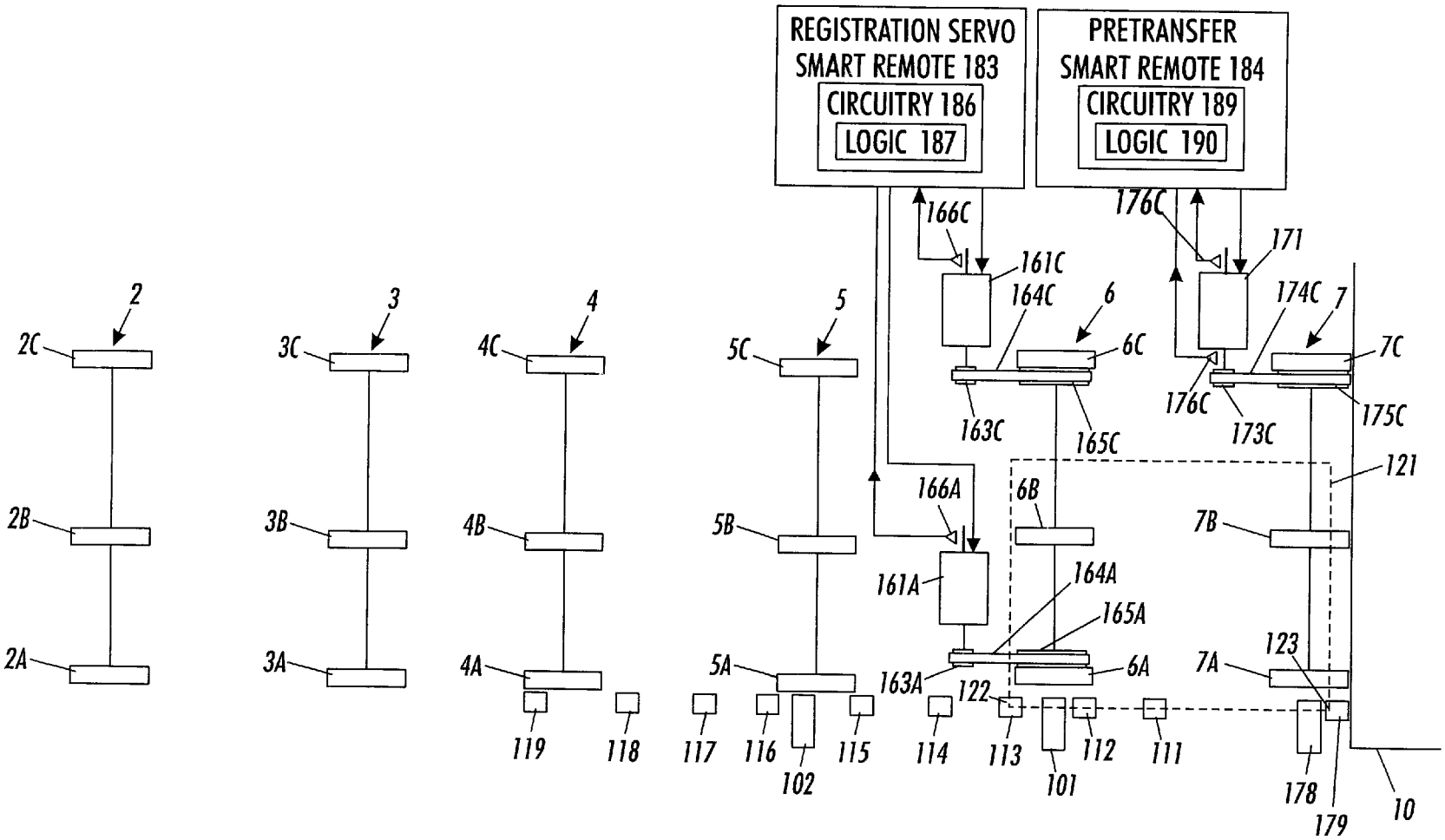
FIG. 7 is a diagram emphasizing the portion of the copy sheet registration system shown in FIG. 3, at a time subsequent to that of FIG. 6.

FIGS. 6 and 7 show the duplex registration process. FIG. 6 shows sheet 121 just before the printing of side one. At the time shown in FIG. 6, remote 184 is responsive to a signal from sensor 179 to perform a final correction before sheet 121 contacts belt 10. After the time shown in FIG. 6, sheet 121 is transferred to duplex loop D and then reenters registration system 100, as shown in FIG. 7. In contrast to FIG. 6, at the time shown in FIG. 7 edge 122 is the trailing edge of sheet 121. At the time shown in FIG. 7, remote 184 is responsive to a signal from sensor 113, instead of sensor 179, to perform the final correction before sheet 121 again contact spelled 10.

In other words, the preferred system acts to send copy sheet 121 into the path towards belt 10, such that edge 122 leads edge 123. Smart remote 184 and sensor 179 act to detect edge 122 at a first time and, in response, remote 184 sends a pulse-width-modulated signal to motor 171 to apply a first force to sheet 121. Subsequently, the preferred system resends sheet 121 into the path towards belt 10, such that edge 123 leads edge 122. Smart remote 184 and sensor 113 act to detect edge 122 at a second time and, in response, remote 184 sends a pulse-width-modulated signal to motor 171 to apply a second force to sheet 121, the second force being a function of the second time.

MIOP 110 sends the programmed sheet process length to remote 184 via the SCB before the reg sync for the sheet being registered. Smart remote 184 uses the programmed sheet process length to select which duplex edge sensor to use.

MIOP 110 sends the programmed sheet process time: this is a time that is calculated by the MIOP and sent to remote 184. This time is the Programmed Sheet Process Length divided by the Photoreceptor speed. This time is used by the pre-transfer board to register the side two trail edge.

When a duplex sheet enters the system 100, MIOP 110 signals both remote 183 and remote 184 that the sheet is a duplex sheet. The reg steering operation for duplex is almost exactly the same as the simplex operation except that the side two lateral target values may be different than the simplex lateral target. For example, lateral targets for side one may be LE (leading edge)=1030 and TE (trailing edge)=1018, while lateral targets for side two may be LE=1018 TE−1030.

The remote 183 will do a course process direction adjustment to the LE of the sheet reducing the amount of process edge variation from ±30 ms to ±1 ms in the process direction. This is exactly what is done in the simplex mode.

Smart remote 184 performs a much different operation in the duplex versus the simplex mode. In the simplex mode a timer is started when the reg sync occurs. Sensor 178 is monitored until the leading edge of the sheet passes the sensor. The difference in time between these two events is calculated and added to the process direction correction factor for the type of sheet being run. Smart remote 184 uses this value to make slight process direction corrections to insure the sheet meets the image correctly on belt 10. There are 32 different types of sheets. Each type of sheet has both a side one and side two correction factor.

In the duplex mode a trail edge sensor is selected depending on the process length of the sheet entering the pre-transfer nip. A timer is started when the reg sync occurs. Smart remote 184 waits until the trail edge of the sheet passes the selected trail edge sensor. The difference between these two events is calculated. Added to this value are 1) the side two correction factor for the selected sheet type, and 2) trail edge sensor variation from nominal for the selected trail edge sensor. This third value will be changed by MIOP 110 when the belt 10 speed is changed and when the angle of the pre-transfer baffle is changed.

The pre-transfer nip make the slight process direction correction so that the trailing edge of the sheet will be lined up with the trailing edge of the image.

Steering Different Sheet Sizes

Figure 8:
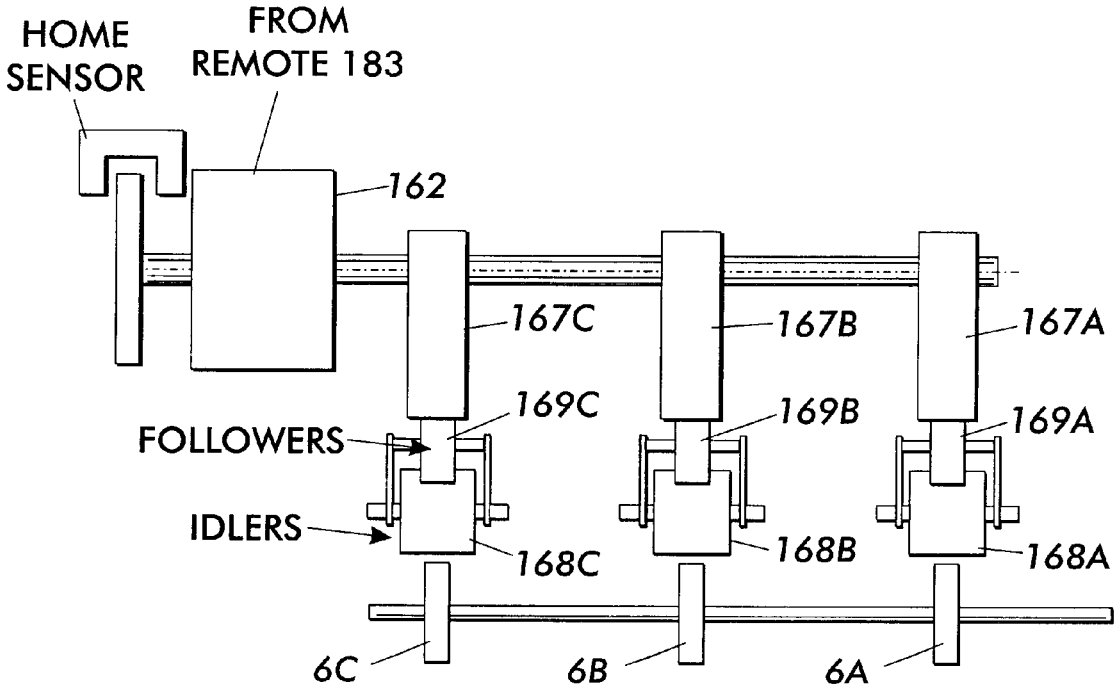
FIG. 8 is another diagram emphasizing another portion of the registration system shown in FIG. 2.
Figure 9:
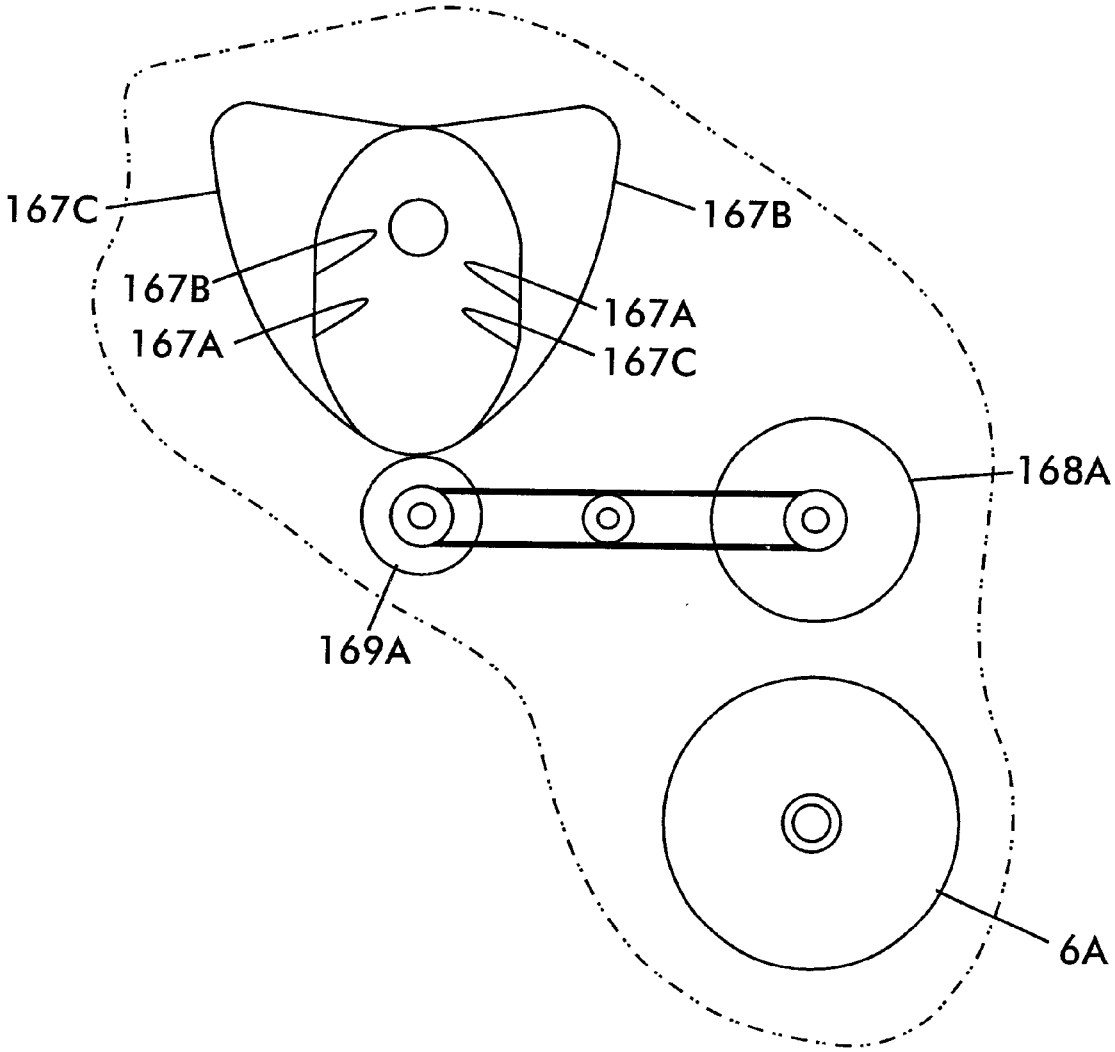
FIG. 9 is another diagram emphasizing another portion of the registration system shown in FIG. 2.

FIG. 8 shows a front view of an engagement mechanism for transport station 6, and FIG. 9 is a side view corresponding to FIG. 8. Cam 167A causes the engagement or disengagement of idler 168A to roller 6A, by acting on cam follower 169A. As presently shown in FIG. 9, cam 167A is causing the disengagement of idler 168A, as cam 167A presses against cam follower 169A.

Similiarly, cam 167B causes the engagement or disengagement of an idler (not shown) to roller 6B, by acting on a cam follower (not shown). Similarly, a cam 167C (not shown) causes the engagement or disengagement of an idler (not shown) to roller 6C, by acting on a respective cam follower (not shown).

Stepper motor 162 drives each of cams 167A, 167B, and 167C. Each of cams 167A, 167B, 167C maintains a fixed angular relation to the other cams.

Figure 10:
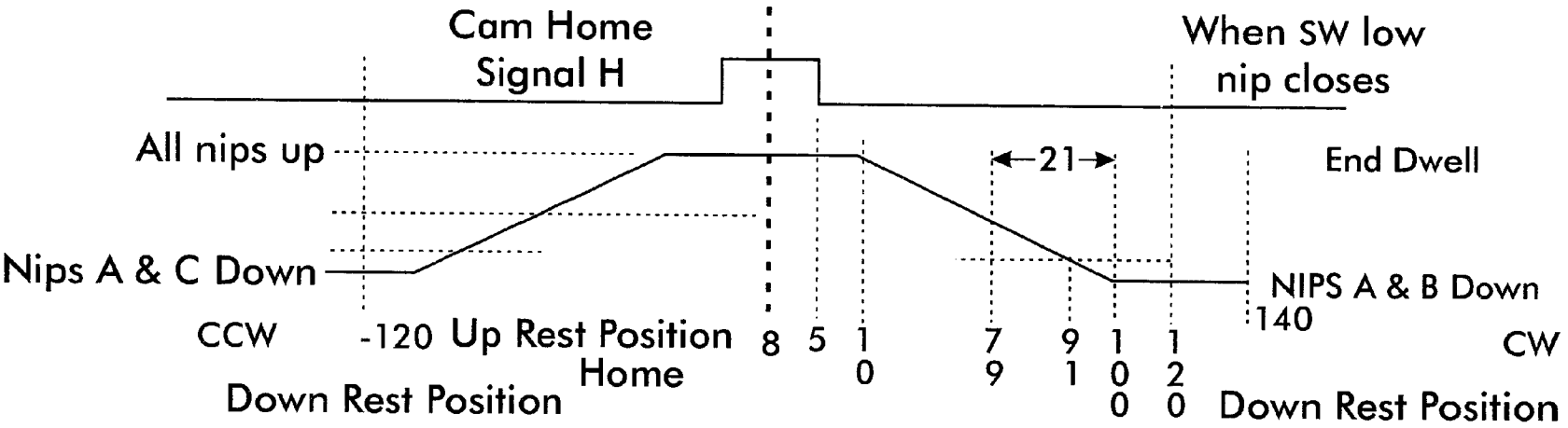
FIG. 10 is a time displacement graph illustrating selective engagement of different parts of the registration system shown in FIGS. 8 and 9.

FIG. 10 is a chart showing different positions of the cams allowing either rollers 6A, 6B, and 6C to be concurrently disengaged, rollers 6A and 6C to be engaged while roller 6B is disengaged, or rollers 6A and 6B to be engaged while roller 6C is disengaged.

Figure 11:
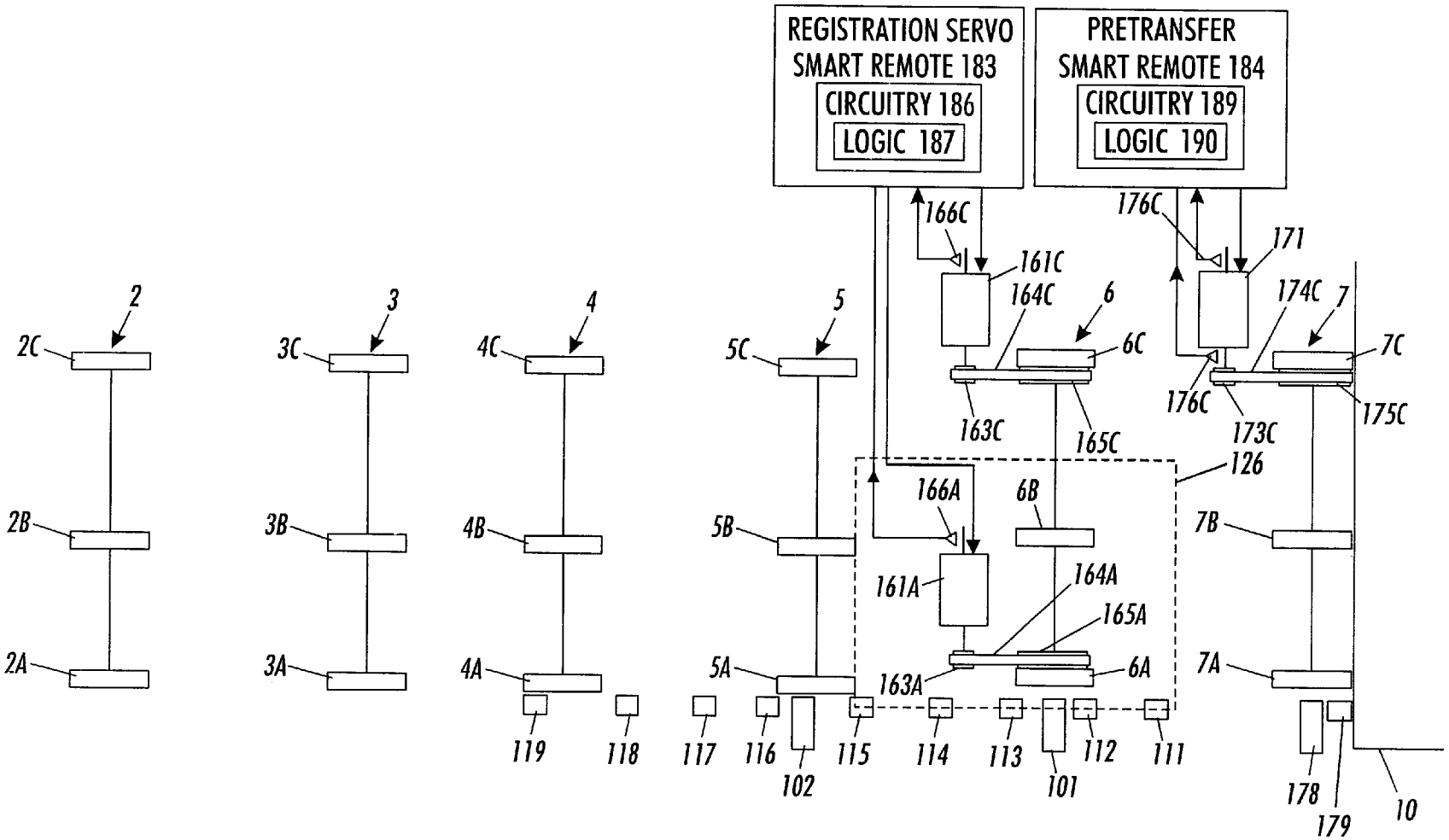
FIG. 11 is a diagram emphasizing the portion of the copy registration system shown in FIG. 3, at a time during the steering of a copy sheet.

Smart remote 183 sends control signals to stepper motor 162 such that two and only two rollers are engaged with there respective idlers in transport station 6, during a steering operation for a particular sheet. FIG. 11 shows preferred system 100 during a steering operation for sheet 126. At the time shown in FIG. 10, the three cams in transport station 6 are in a position such that roller 6A and 6B are engaged with their respective idlers, while roller 6C is disengaged from its respective idler. In other words, at the time shown in FIG. 12, only rollers 6A and 6B act to steer sheet 126.

Figure 12:
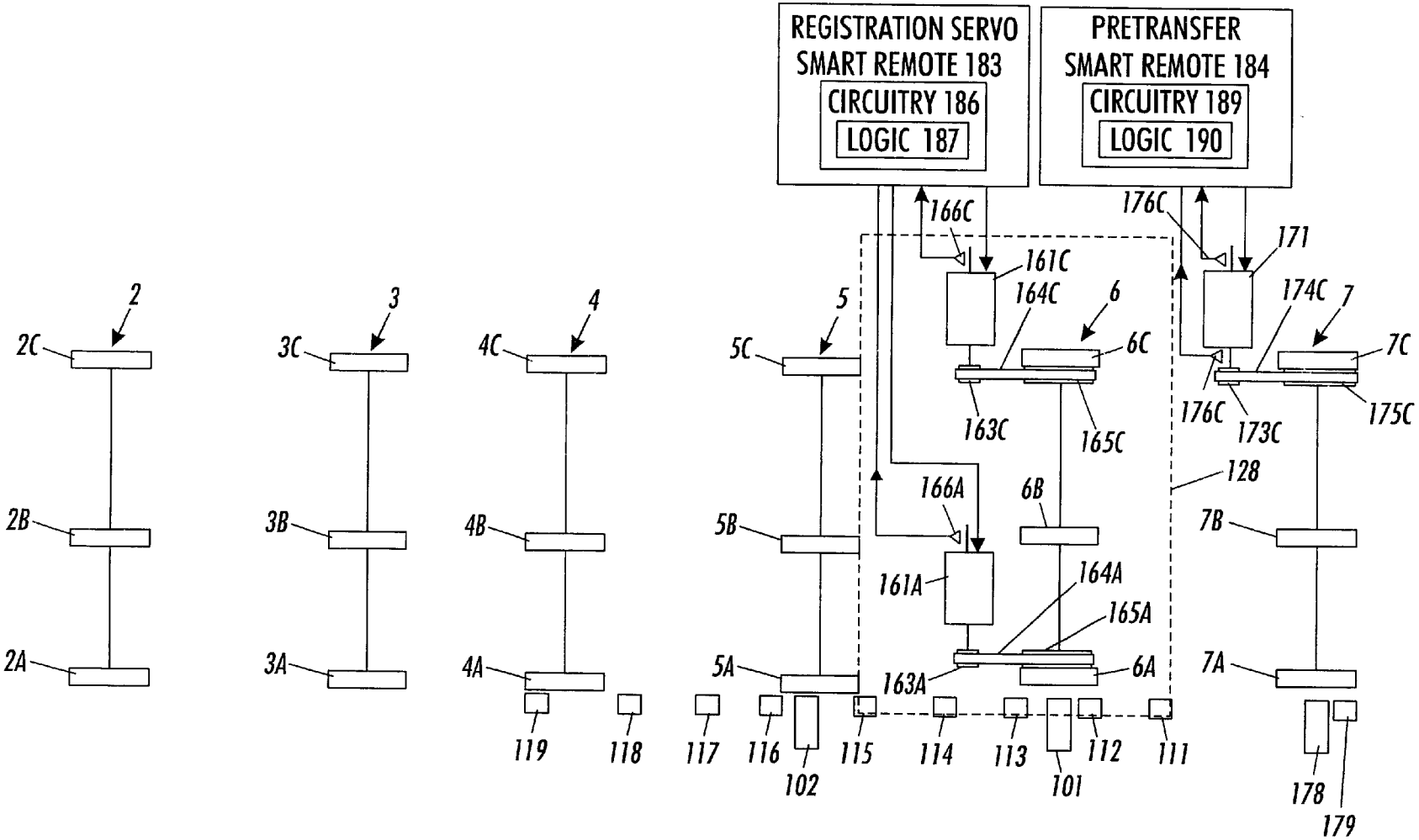
FIG. 12 is a diagram emphasizing the portion of the copy registration system shown in FIG. 3, at a time during the steering of a different copy sheet.

FIG. 12 shows a preferred system 100 during a steering operation for sheet 128, which is wider than sheet 126. At the time shown in FIG. 12, the three cams in transport station 6 are in a position such that roller 6A and 6C are engaged with their respective idlers, while roller 6B is disengaged from its respective idler. In other words, at the time shown in FIG. 13, only rollers 6A and 6C act to steer sheet 128.

In other words, system 100 acts to send sheet 126 into a sheet path toward belt 10, and to send sheet 128 into the sheet path toward belt 10. System 10 acts to adjust a position of sheet 126 by applying a first force from roller 6A, which is a type of actuary. Concurrently, system 100 applies a force, different from the first force, from roller 6B. Subsequently, system 100 adjusts a position of sheet 128 by applying a second force from roller 6A. Concurrently, system 100 applies a force, different from the second force, from roller 6B.

As shown in FIG. 3, rollers 6B and 6C are driven from a common motor 161 C.

Compensation for Machine Part Variation—Roller rephasing

During an intersheet gap, a rephasing algorithm adjusts the rollers' angular position such that the leading edge of the sheet always meets the roller close to a target angular nip position. The maximum rephasing distance is equivalent to one revolution of the nip. Provisions for a slow drift need to be made to prevent excessive nip wear caused by the edge of the sheet always contacting the same spot on the roll. The drift can be in the order of one degree per sheet. Active learning will cancel out the error that this may cause.

The algorithm will compute the expected arrival time of a sheet into the registration station from an upstream process edge sensor time stamp and the measured sheet velocity. As soon as the previous sheet has left the registration nip, the nip will undergo a constant acceleration/deceleration profile (triangular velocity profile) to rephase the nip. Time available for rephasing is approximately 100 ms. The maximum velocity increase can be computed from $$2\pi=0.5\Delta\omega_{max}{}^{*}\ 0.100$$

$$\Delta\omega_{max}=40\ \pi\text{rrad/sec}=20\ \text{rev/sec}=1200\ \text{rpm}$$

This corresponds to an increase in nip surface velocity of 3.13 m/s. The maximum acceleration is $$\alpha_{max}=40\pi/0.05=800\ \pi\text{rrad/sec}^2$$

with a 4:1 ratio timing belt drive the maximum acceleration of the motor is about 10000 rad/(s*s).

Roller rephasing is performed for both transport station 6 and transport station 7.

Figure 13:
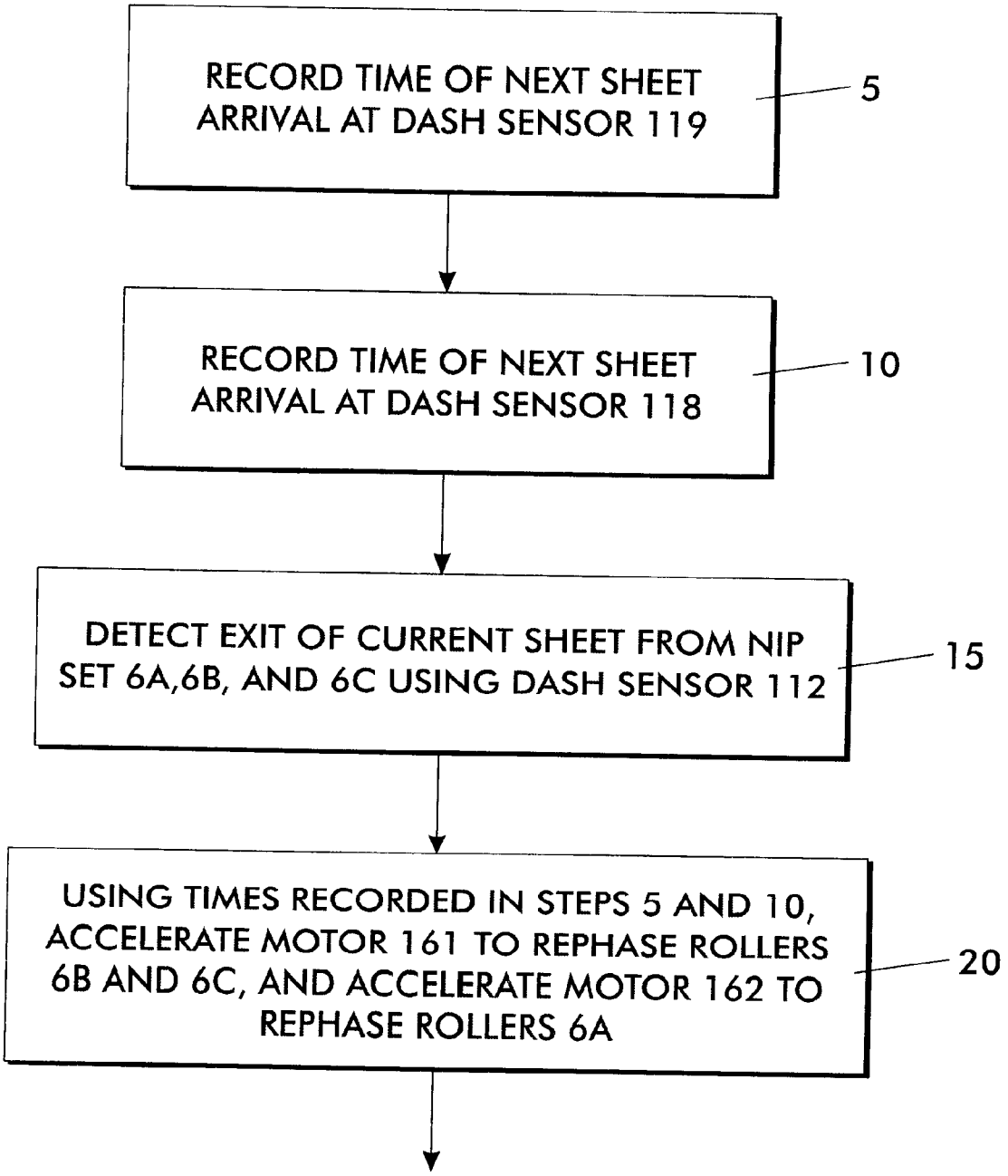
FIG. 13 is a flow chart showing a process performed by the preferred registration system.
Figure 14:
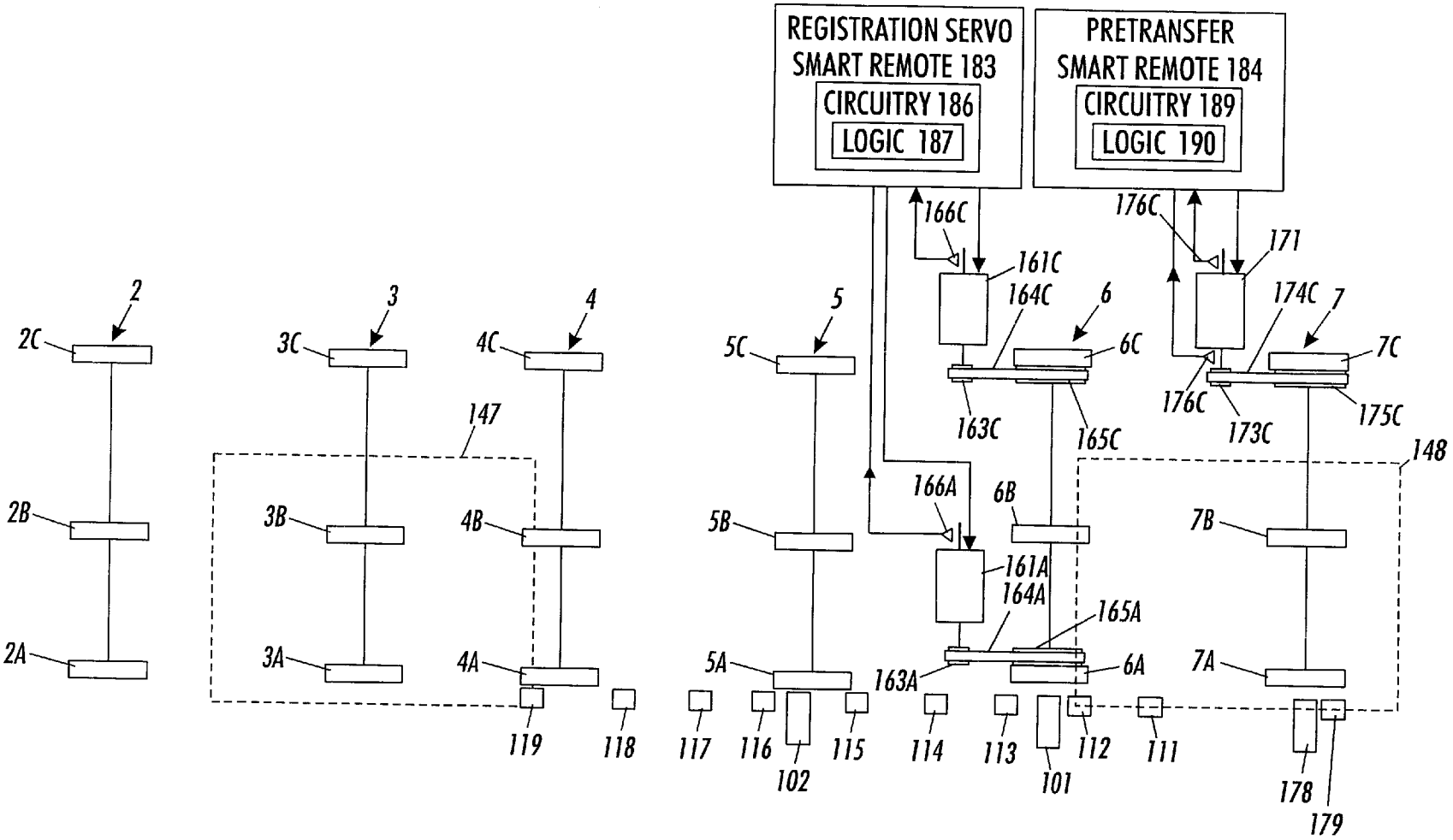
FIG. 14 is a diagram emphasizing the portion of the copy registration system shown in FIG. 3, at a different time.

FIG. 13 shows a process performed by remote 183 rephasing of the rollers in transport station 6, during a time represented in FIG. 14. Smart remote 183 receives a signal from process edge sensor 119 indicating the arrival of a leading age of a next sheet 147. (Step 5). Smart remote 183 receives a signal from process edge sensor 118 indicating the arrival of the leading edge of sheet 147 (step 10). Thus, remote 183 determines the location of sheet 147 at a certain time using the output of sensor 119, and determines the velocity of sheet 147, by subtracting the difference between the arrival time of the signal from sensor 118 and the arrival time of the signal from sensor 119.

Smart remote 183 is responsive to a signal from sensor 112, indicated the exit of current sheet 148 from transport station 6. (Step 15). Thus, because each of rollers 6A, 6B, and 6C is now free of a sheet, remote 183 accelerates motor 161C such that nips 6B and 6C will be in a known position upon the arrival of next sheet. Independently of the acceleration of motor 161C, remote 183 accelerates motor 161A so that roller 6A will be in a known position upon the arrival of next sheet 147.

In other words, belt 10 is a type of substrate for holding an image. Roller 6A is essentially a type of a revolving member to propel sheets along a path leading to belt 10. The preferred system acts to send sheet 148, into the path, and to subsequently send sheet 147 into the path. Roller 6A initially contacts the leading edge of sheet 148 at a position along a circumference of roller 6A. After sheet 148 ceases contacting roller 6A, remote 183 applies a pulse-width-modulated signal to server motor 161A, to supply a force to roller 6A, such that the leading edge of sheet 147 initially contacts roller 6A at a second position, the second position having a predetermined displacement relative to the first position. As described above, it is presently preferred that this predetermined displacement be non-zero, having a value of approximately one degree.

Compensation for Machine Part Variation—Learning Sensor Location Variation

The side two process edge sensors are spaced between 37 mm to 51 mm apart. Smart remote 184 is responsive to a measure of the spacing between these sensors. A sensor learning routine determines a precise location of each sensor relative to each other. This learning routine will most likely be run by service personel during install or whenever certain parts related to the sensor bar are replaced. A process edge sensor PEi (i depends on nominal sheet length) in row of process edge sensors PEn(n=1,2,3 . . . 10) measures time of arrival of the trailing edge of the sheet. Together with the desired time of arrival of the trailing edge, a fine correction can be computed and executed by remote 184. The sheet must be registered to the PR belt to be within ±250 microns.

Figure 15:
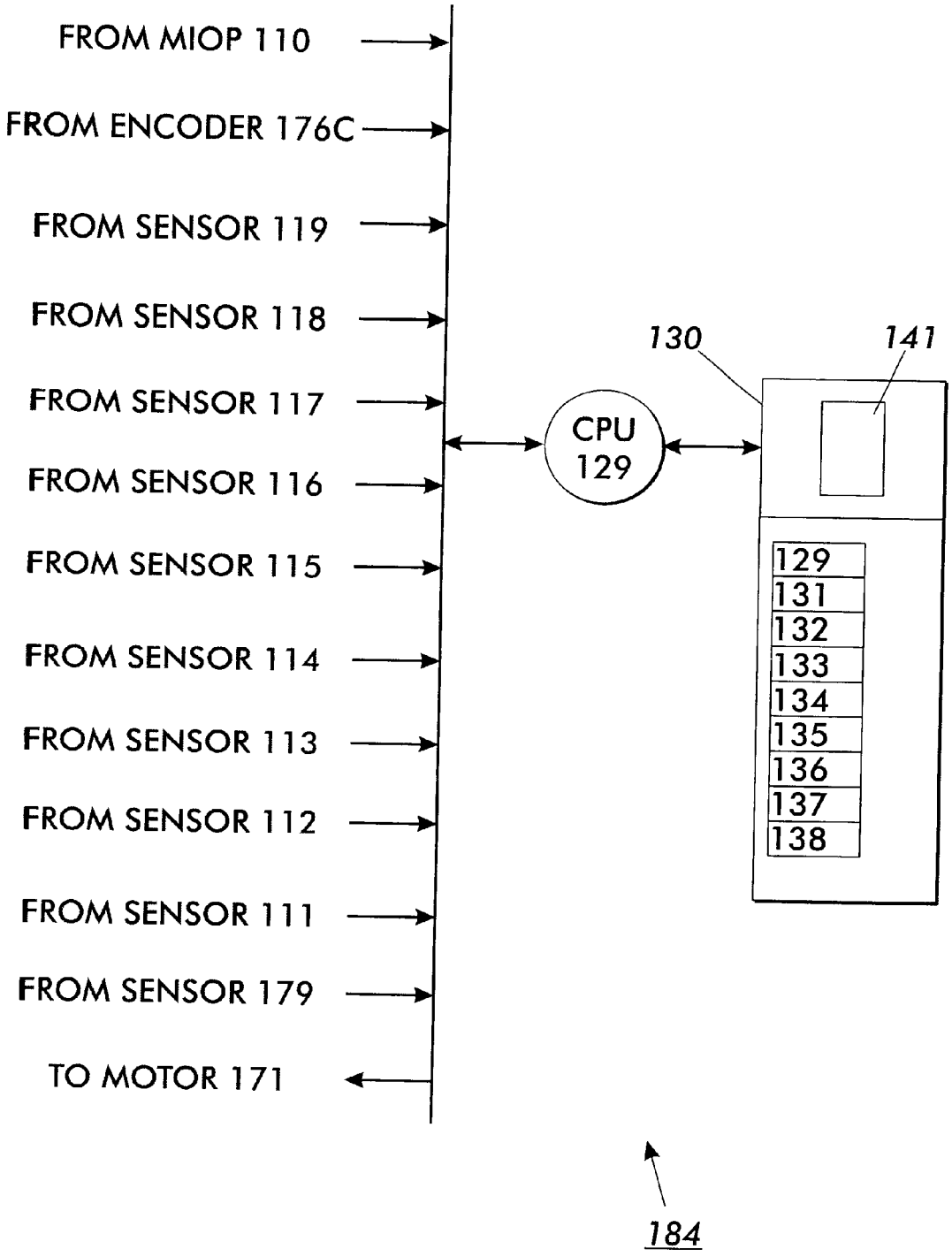
FIG. 15 is a diagram emphasizing certain feature in remote 184.

FIG. 15 shows a block diagram emphasizing certain features of remote 184. Smart remote 184 includes a general purpose central processing unit (CPU) that executes instructions 141 residing in random access memory 130. CPU 129 receives and sends signals to MIOP 110, encoder 176C, motor 171, and sensors 119, 118, 117, 116, 115, 114, 113, 112, 111, and 179. One of ordinary skill would know that various types of interfaces may be employed to enable CPU 129 to send and receive these signals.

Memory location 138 stores a value representing a location of sensor 118. Memory location 137 stores a value representing a location of sensor 117. Memory location 136 stores a value representing a location of sensor 116. Memory location 135 stores a value representing a location of sensor 115. Memory location 134 stores a value representing a location of sensor 114. Memory location 133 stores a value representing a location of sensor 113. Memory location 132 stores a value representing a location of sensor 112. Memory location 131 stores a value representing a location of sensor 111. Memory location 129 stores a value representing a location of sensor 179.

Belt 10 is moved such that a sheet will not contact belt 10 while the sheet is in rollers 7A, 7B, and 7C. At the start of the routine a sheet of the 20.5", 20#, sheet is fed. The lateral edge of the sheet is registered as normal. Once the sheet enters rollers 7A, 7B, and 7C, remote 184 slows the sheet and monitors trailing edge sensor 119 for activation. Smart remote 184 activates a counter to count the number pulses from encoder 176C, and performs dynamic encoder interpolation to get the fraction of the encoder pulse. As the sheet travels along the path, the sheet trips sensors 118 through 111. As a result, remote 184 stores a signals indicating locations of sensors 118, relative to sensor 119, into memory 130.

In other words, system 100 essentially sends a reference sheet into the path. System 100 detects the reference sheet at a first time in the path, using sensor 118 (detect reference sheet at one of the PE sensors). System 100 detects the reference sheet at a second time in the path, using sensor 117. Subsequently, during a normal copy operation, system 100 sends a plurality of sheets into the path, and applies correction forces, from rollers 7A, 7B, and 7C, that are a function of a difference between the first and second times.

Figure 16:
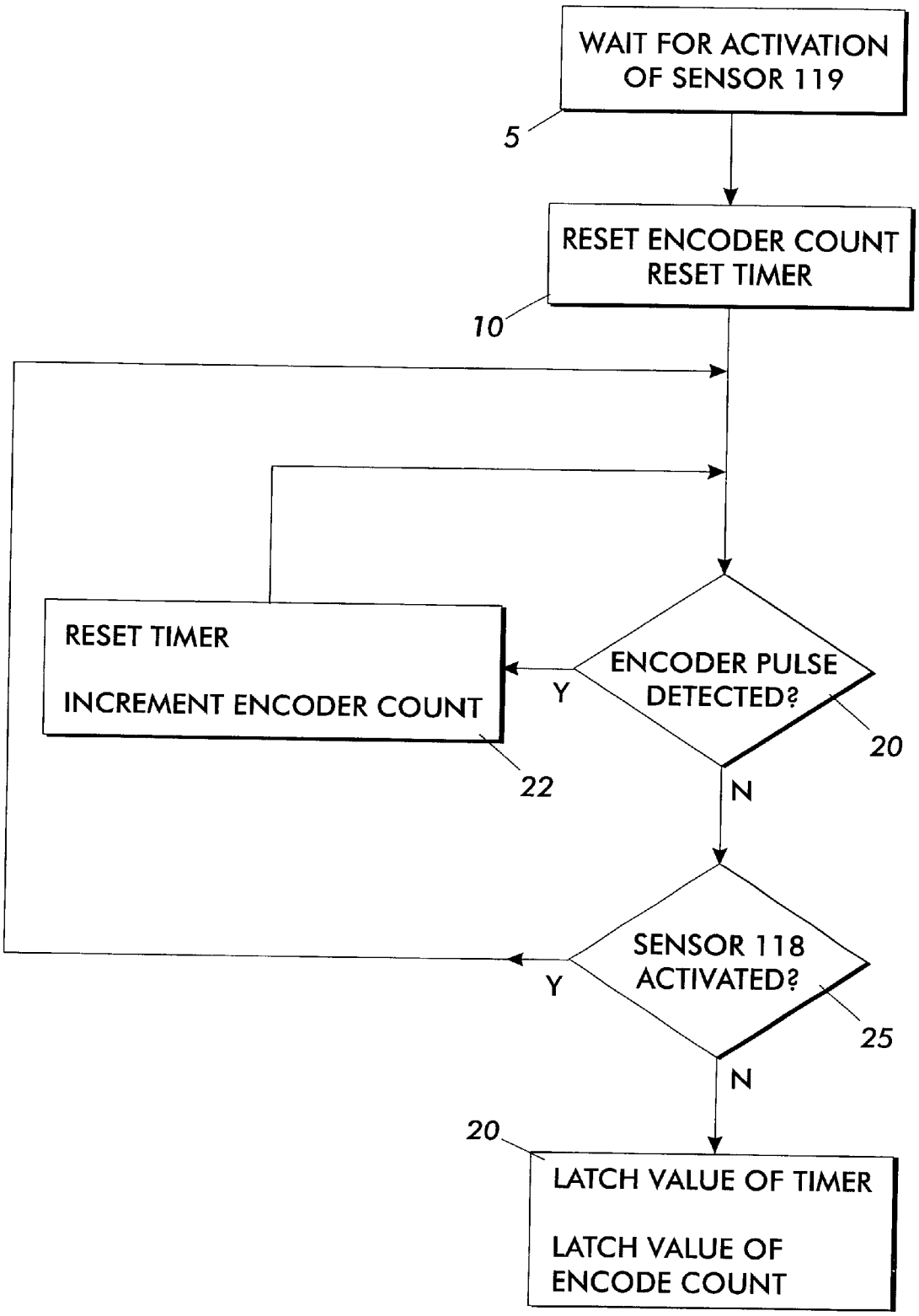
FIG. 16 is a flow chart showing a process for adjusting to variations in sensor locations.

FIG. 16 shows a process performed by remote 184 to record signals representing a distance between sensors. During the process shown in FIG. 11, remote 184 resets the hardware timer in response to each encoder pulse from encoder 176C. Thus, remote 184 employs the hardware timer to perform a type of interpolation to estimate a fraction of a time corresponding to the time between pulses from encoder 176C.

More specifically, after feeding the reference sheet, remote 184 waits for activation of sensor 119 (step 5) After activation of sensor 119, remote 184 resets a counter that counts the number of pulses from encoder 176C and resets a hardware timer (step 10). If remote 184 detects an encoder pulse (step 20) remote 184 increments a counter and resets the hardware timer (step 22). If remote 184 detects activation of sensor 118 (step 25), remote 184 stores the number of encoder pulses and the current value of the hardware timer in a memory location associated with sensor 118. (step 30). Smart remote 118 performs the process corresponding to steps 20, 22, 25, and 30 for each of sensors 117, 116, 115, 114, 113, 112, 111, and 179.

In other words, the process of adjusting for variations in sensor locations includes sending a reference sheet into the path toward belt 10. Smart remote 184 counts a number of encoder pulses from encoder 176C. Remote 184 uses the hardware timer to determine a time between activation of a sensor and the most recent encoder pulse. Ultimately, the encoder pulse values and timer values stored in memory effect the motor control signals generated by remote 183 and remote 184. In other words, ultimately, the force applied to sheets in the sheet path is a function of the number of encoder pulses counted and the time recorded by the hardware timer. In order to register a sheet correctly to the trailing edge, remote 184 is responsive to measured locations of all of the trailing process edge sensors relative to process edge sensor 179. The sensor locations are stored in flash memory on remote 184.

Maintenance Prediction

System 1000 determines when components may require maintenance before they fail. For example, too many encoder counts between sensors can mean that the drive rollers are too small, and need replacement. Thus, system 100 acts to detect the presence of the sheet at a first location in the path at a first time, using sensor 115, and to detect the presence of the sheet at a second location in the path at a second time, using sensor 114. System 100 counts a number of signals from encoder 166A occurring between the first and second times. The number of signals from encoder 166A is effectively a signal indicating a number of revolutions of rollers 6A. System 100 selectively generates a visual signal instructing a technician to replace rollers, depending on whether the number counted in the counting step is above a threshold.

Figure 17:
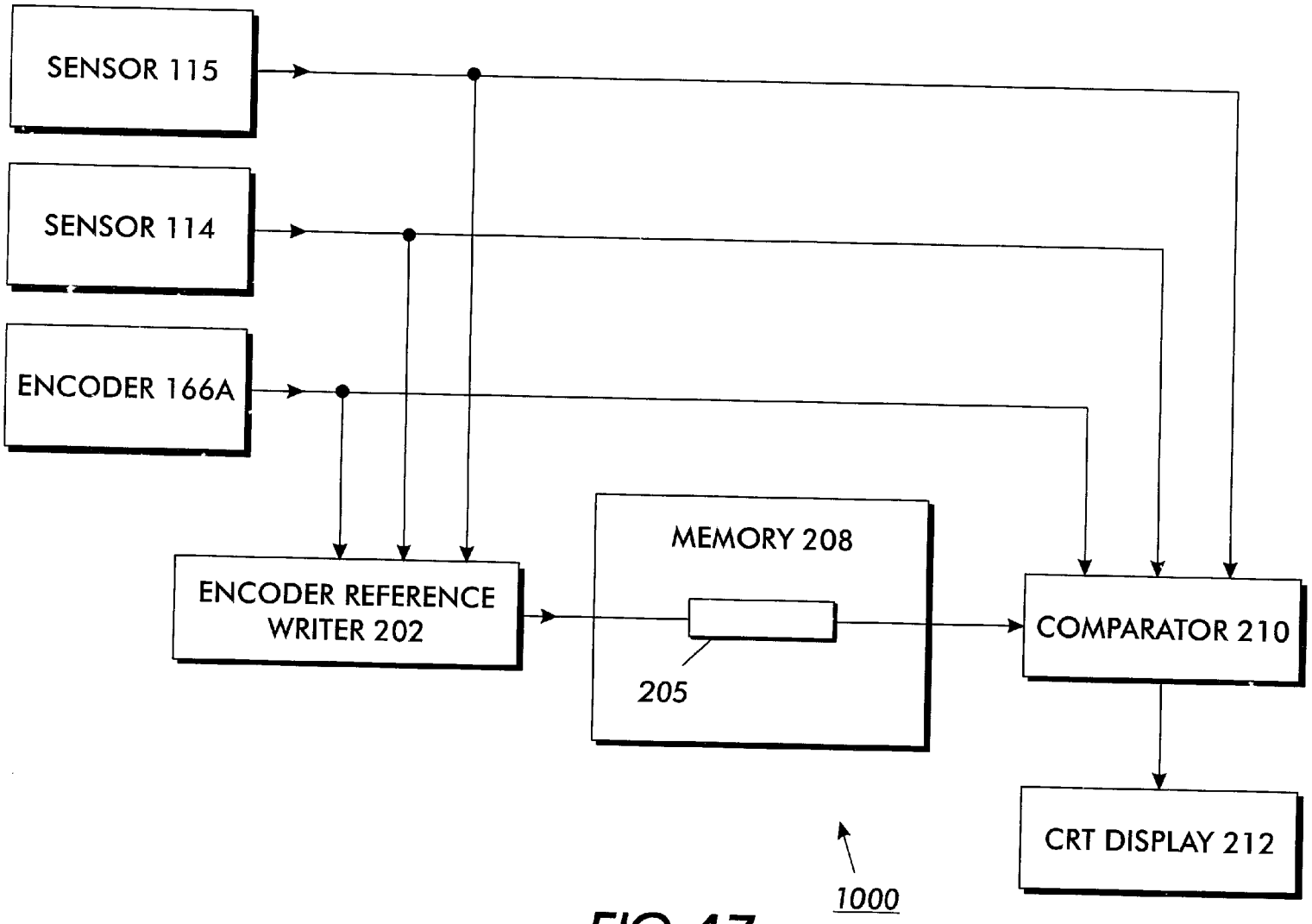
FIG. 17 is a diagram of some circuitry used to signal a user or technician to perform preventive maintenance.

FIG. 17 shows specific circuitry for performing the processing described in the previous paragraph. Encoder reference writer 202 may be invoked upon initial installation of system 1000. Writer 202 receives respective signals from sensor 115, sensor 114, and encoder 166A and, responsive to these received signals, writer 202 writes encoder data into memory location 205 of memory 208. The encoder data written to location 205 represents the number of encoder counts between activations of sensors 114 and 115. The encoder data may be raw data or may be more refined, reduced, data. The encoder data is in effect a measure of a circumference of roller 6A.

Subsequently, during operation of system 1000, comparator 210 compares the reference data in location 205 to signals received from sensor 115, sensor 114, and encoder 166A. Thus, encoder 210 detects when there are an excessive number of rotations of roller 6A per increment of sheet movement, and comparator 210 displays a warning or other type of information on CRT display 212.

Thus, system 100 detects roller 6A rotations, which is a type of process in system 1000. Writer 202 stores a signal into location 205 in response to detecting this rotation. Subsequently, system 1000 performs printing operations for many weeks. During these printing operations, comparator 210 detects rotations of roller 6A and performs a comparison responsive to this detection and the signal stored in location 205. In response, comparator 210 selectively displays a condition on CRT display 212.

The process detected by writer 202 and comparator 210 also includes detecting an operation of sensor 114, which generates a light signal via a light omitting diode (LED) to detect the passage of a sheet.

Another example of maintenance prediction will now be described in connection with FIG. 18. Remotes 183 and 184 each regulate motor torque by pulse width modulation (PWM). The longer the pulse width the higher the drive torque. When the machine is new it takes a certain level of PWM to drive the shafts with no sheet. When bearings start to bind up the PWM will increase. In response to monitoring PWM to a particular motor, system 1000 selectively sets a flag to tell the service personel that the PWM has exceeded a predetermined level, thereby instructing the service personel to replace bearings or drive components in the motor, before the motor binds up.

In other words, roller 6A is configured to propel a sheet along the path to belt 10. Motor 161A is configured to propel roller 6A. Smart remote 183 generates control signals for motor 161A, and encoder 166A generates encoder signals in accordance with a movement of the motor 161 A. System 1000 acts to selectively generate a visual signal instructing a technician to replace motor bearings, depending on a function of a width of the control signals and a number of encoder signals.

Figure 18:
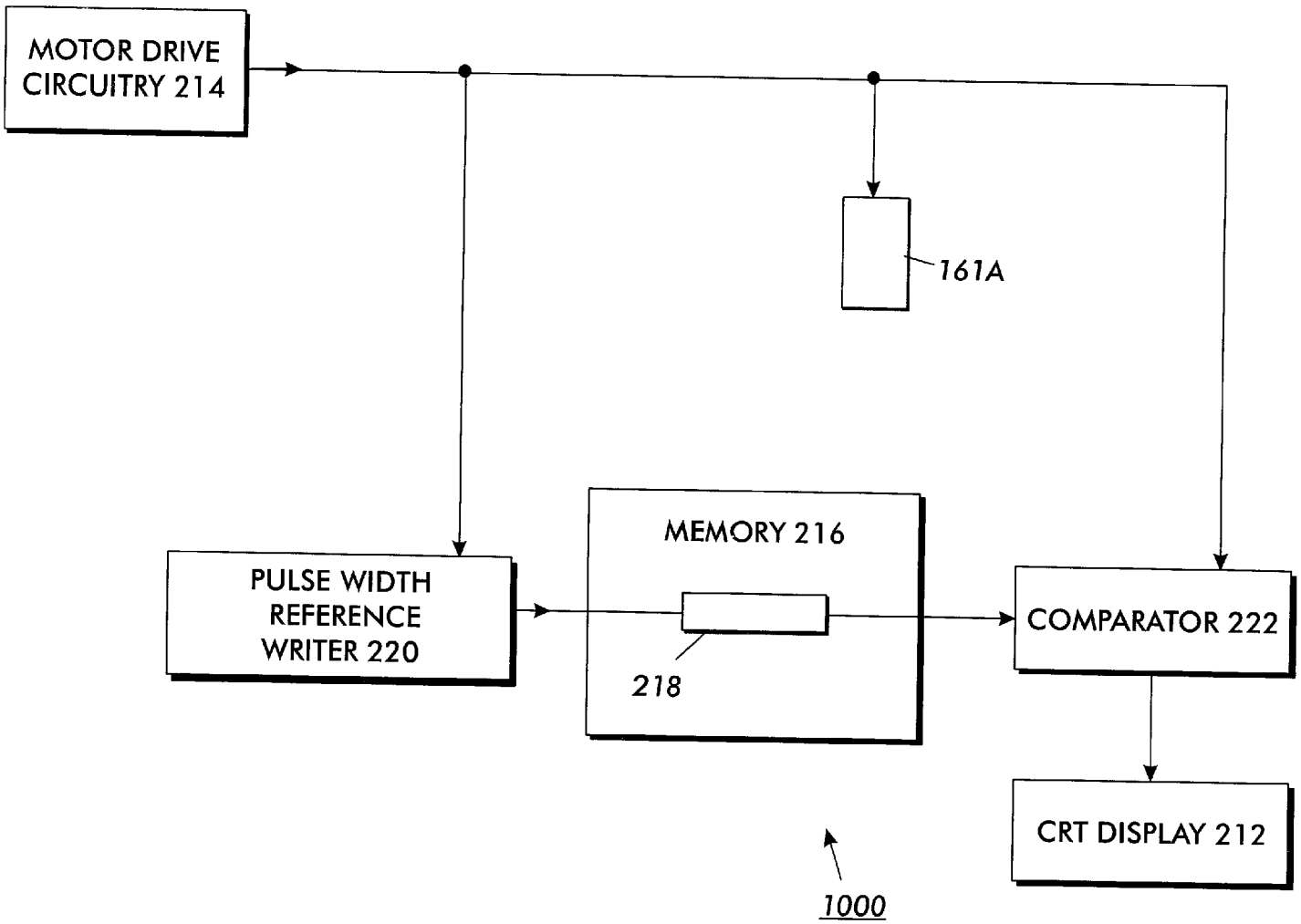
FIG. 18 is a diagram of other circuitry used to signal a user or technician to perform preventive maintenance.

FIG. 18 shows specific circuitry for performing the processing described in the previous paragraph. Motor drive circuitry 214 is located in remote 183. Pulse width reference writer 220 may be invoked upon initial installation of system 1000. Writer 220 receives signals from circuitry 214 and, responsive to these received signals, writer 220 writes pulse width data into memory location 218 of memory 208. The pulse width data written to location 218 represents the pulse width, or electrical drive force, required to move the motor when there is no sheet in the transport station. The pulse width data may be raw data or may be more refined, reduced, data.

Subsequently, during operation of system 1000, comparator 222 compares the reference data in location 218 to signals received from circuitry 214. Thus, encoder 222 detects when there is excessive electrical drive force required to rotate the motor, and comparator 222 displays a warning or other type of information on CRT display 212.

Thus, system 1000 detects generation of an electrical drive force for a motor, which is a type of process in system 1000. Writer 220 stores a signal into location 218 in response to detecting this force. Subsequently, system 1000 performs printing operations for many weeks. Between sheet transport operations, comparator 222 detects electrical drive force and performs a comparison responsive to this detection and the signal stored in location 218. In response, comparator 222 selectively displays a condition on CRT display 212.

Figure 19:
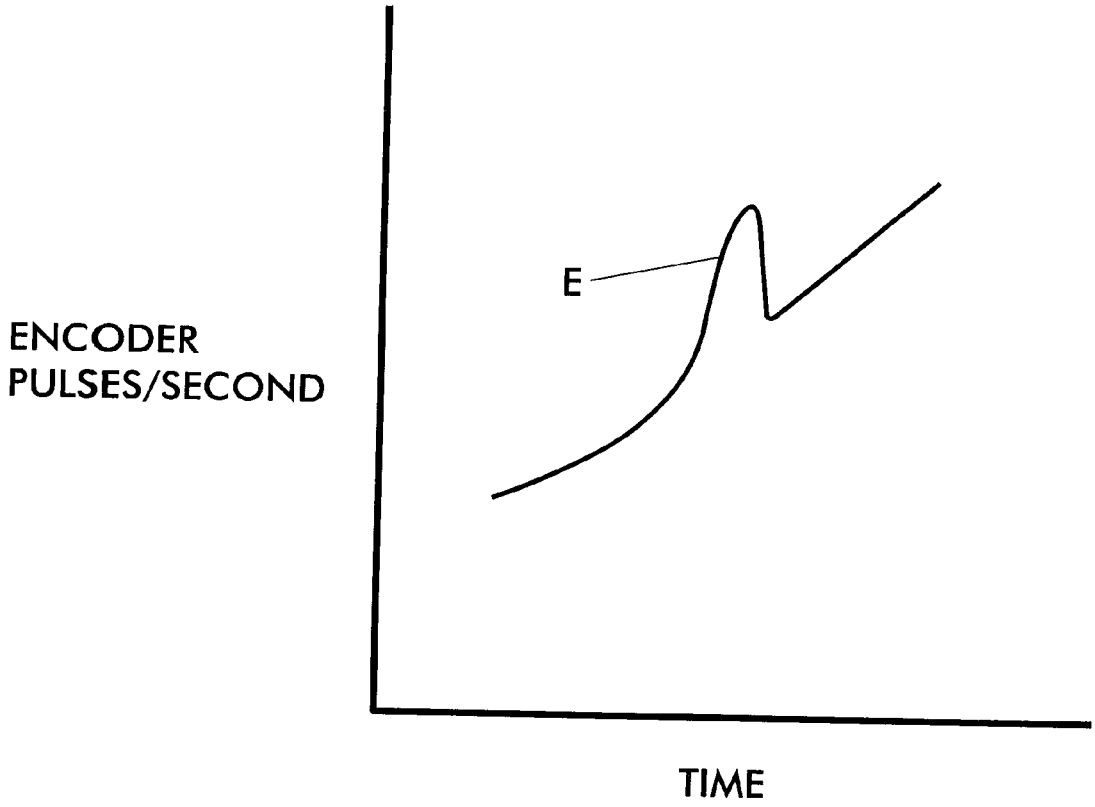
FIG. 19 is a graph showing rapid roller acceleration resulting from roller malfunction.

Another example of maintenance prediction will now be described in connection with FIG. 19 and 20. While a sheet is being registered it requires a certain torque to speed profile. If the rollers were to become contaminated the rollers may slip at high torque values. A slip can be determined by rapid changes in acceleration. In other words, system 1000 selectively generates a visual signal instructing technician to clean or replace rollers, depending on whether the rate of change of a number of encoder pulses, per unit time, is above a threshold as would be the case for curve E, for example, in FIG. 19.

Figure 20:
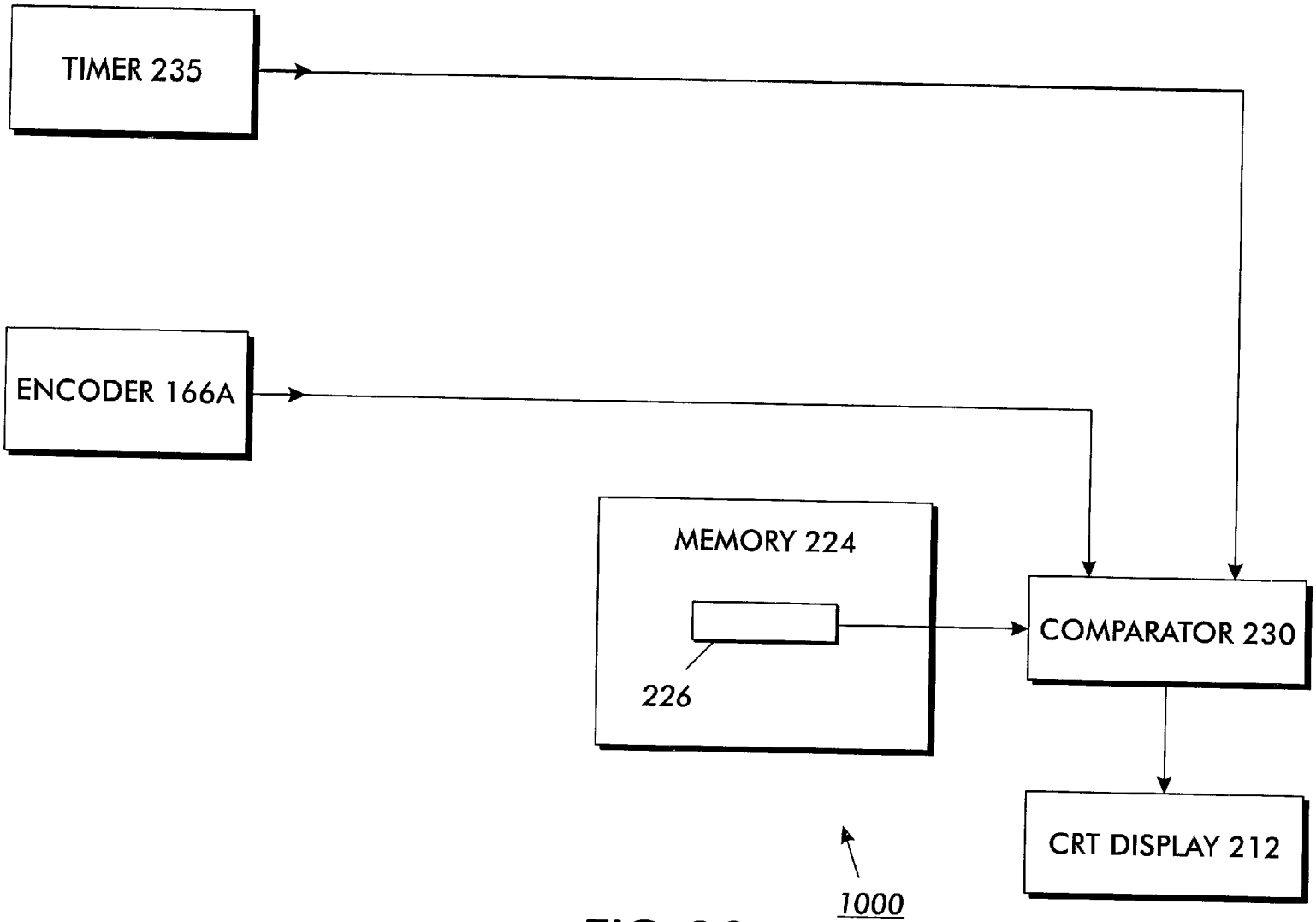
FIG. 20 is a diagram of other circuitry used to signal a user or technician to perform preventive maintenance.

FIG. 20 shows specific circuitry for performing the processing described in the previous paragraph. Acceleration data to location 226 represents a threshold for an acceptable level of acceleration of motor 161A. The acceleration data may be raw data or may be more refined, reduced, data. During operation of system 1000, comparator 230 compares the reference data in location 226 to signals received from encoder 166A and timer 235. Thus, encoder 230 detects when there is excessive acceleration of motor 161A, and comparator 230 displays a warning or other type of information on CRT display 212, to signal the operator that the sheet reg rollers need to be cleaned or replaced.

Each of the comparators and writers described above may be implemented as a respective subprocedure of instructions executed by one of the general purpose processors in system 1000.

More Detailed Description of the Preferred Embodiments

The circumference of each of rollers 6A, 6B, and 6C is 6.5 inches. The distance between the axis of rollers 6A, 6B, and 6C and the axis of rollers 7A, 7B, and 7C is 6.5 inches. The distance between the axis of rollers 7A, 7B, and 7C and the maximum sheet tack point on belt 10 is 4 inches.

The circumference of roller 7C is configured to propel a sheet toward belt 10. Drive pulley 175C is fixed to roller 7C, to propel roller 7C. Motor drive pulley 173C is coupled to propel pulley 175C, such that a ratio of a number of revolutions of pulley 175C to the number of revolutions of pulley 173C is an even number. In the preferred embodiments, this revolution ratio is achieved by having the circumference ratio between pulley 175C and pulley 173C be an even number, thereby canceling out certain errors in the shapes and dimensions of parts in the preferred system.

Drive pulley 165C is fixed to roller 6C to propel roller 6C. Motor drive pulley 163C is coupled to propel pulley 165C, such that a ratio of a number of revolutions of pulley 165C to the number of revolutions of pulley 163C, is an even number. In the preferred embodiments, this revolution ratio is achieved by having the circumference ratio between pulley 165C and pulley 163C be an even number.

Drive pulley 165A is fixed to roller 6A, to propel roller 6A. Motor drive pulley 163A is coupled to propel pulley 165A, such that a ratio of a number of revolutions of pulley 165A to the number of revolutions of pulley 163A, is an even number. In the preferred embodiments, this revolution ratio is achieved by having the circumference ratio between pulley 165A and pulley 163A be an even number.

Smart remote 183 measures the input registration and send data back to the main control processor (MIOP) 110 as feedback to adjust the sheet feed times or the inverter exit time so that the sheets entering the registration transport are close to the center of a process input window.

Responsive to receiving a signal from sensor 112, system 100 reads a sheet position signal from sensor 102 and reads a sheet position signal from sensor 101. Responsive to receiving a signal from sensor 179, system 100 reads a sheet position signal from sensor 101 and reads a sheet position signal from sensor 178. System 100 calculates the final sheet lateral and skew registration, and its variance from where it should be is determined. The sheet target value (TV) is then updated: TV=TV*(1−L)+(CSTV*L), where L=Learning rate in %, CSTV=Current Sheet Target value. This learning process takes approximately 5 sheets before the sheet is fully centered in the registration window. When the job ends, the target value is stored in flash memory on remote 183 so that the first sheet of the next job will be centered in the registration window. This learning process need only be done once in the machine life when a new type of sheet is introduced. During this set-up the first two to three sheets may be out of spec and may have to be discarded.

The table of speed ratios versus sheet type is continuously updated using a similar learning routine as described above.

Attributes such as sheet thickness, mass, friction, etc. affect where the sheet ends up for a given profile. This means that if 20# sheet is running centered in the registration window and the sheet supply is changed to say 110# sheet, the first few sheets will most likely be out of spec. unless a new target value for 110# sheet is loaded beforehand. By maintaining target values for each sheet feed tray the machine may have and switching to the new target value before the sheet is registered, there will be no misregistered sheets during changes in sheets during a run.

Up to 32 (16 sheet types×2 sides) target values are stored in nonvolatile, flash memory on remote 183. These values are downloaded to the MIOP and saved to disk at the end of every job. The same values are uploaded at the beginning of each power up to the remote 183. Sheet is grouped into these 32 sheet types. The sheets sheet type number (#0–15) and side (1 & 2) must be downloaded before the start of the registration process for that sheet.

Sheet sensors 119, 118, 117, 116, 102, 115,114, 113, 101, 112, 111, 178, and 179 are mounted on a common bar that can be removed from system 100 as a unit.

Figure 21:
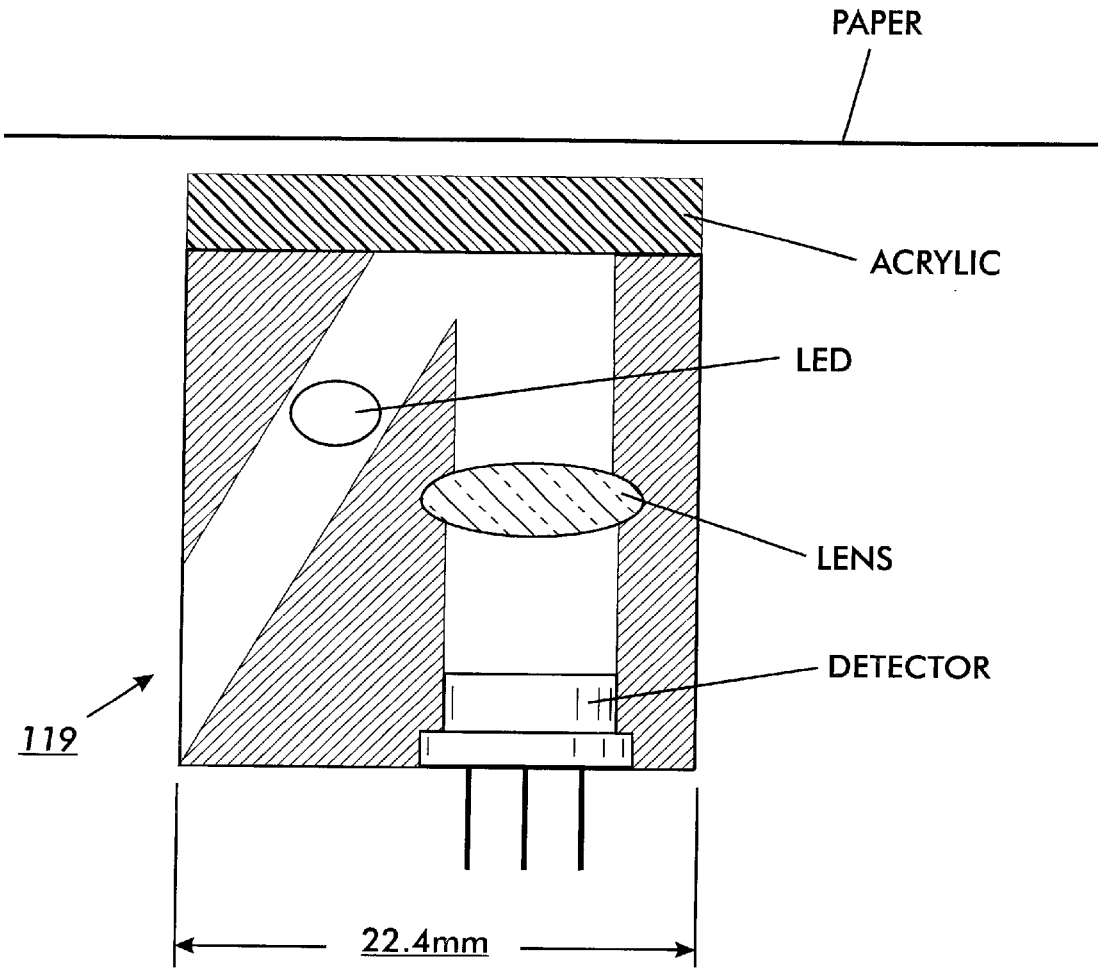
FIG. 21 shows process edge sensor 119.

FIG. 21 shows process edge sensor 119. Sensor 119 is an optoelectric reflective sensor with a gallium aluminum arsenide (Infrared) LED and phototransistor detector with adaptive interface. Sensor 119 has a trip point repeatability of+25 microns.

Each of sensors 118, 117, 116, 115, 114, 113, 112, 111,and 179 has the same hardware structure as sensor 119.

Figure 22A:
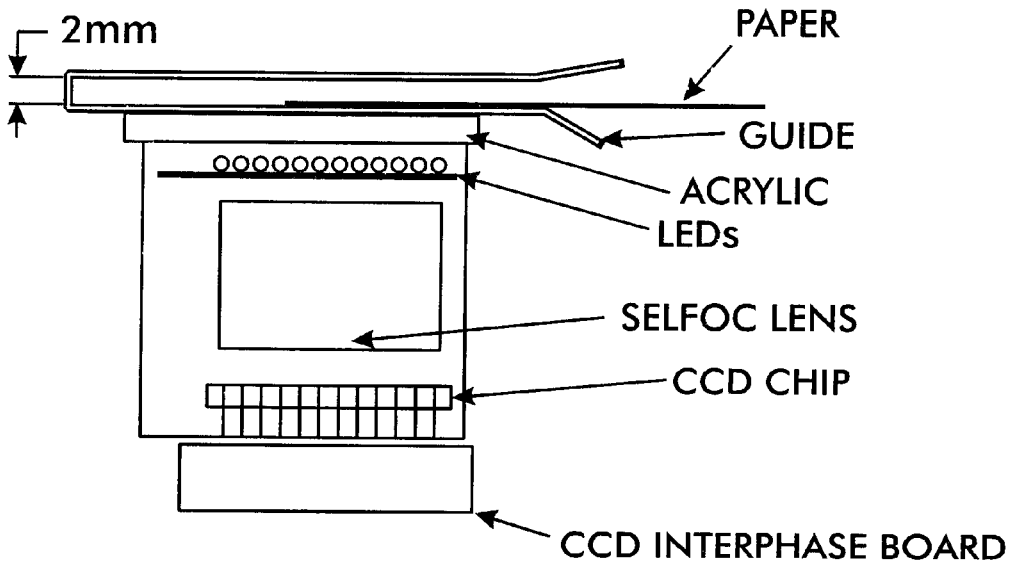
FIG. 22A shows CCD sensor 102 and FIG. 22B is a side view corresponding to FIG. 22A.
Figure 22B:
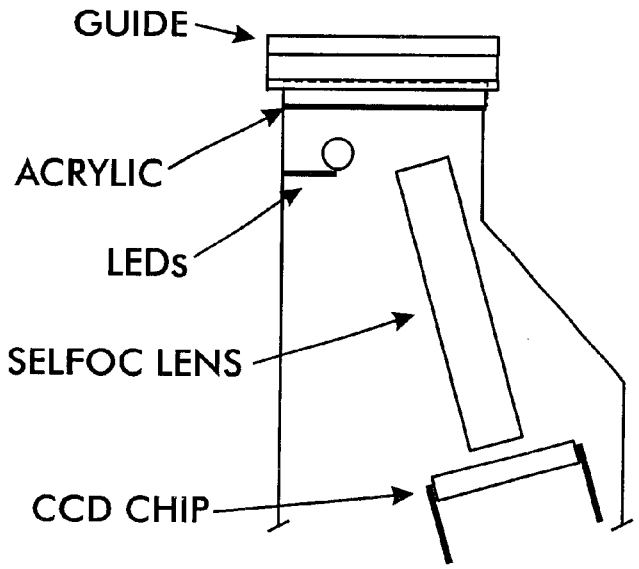

FIG. 22A shows CCD sensor 102 and FIG. 22B is a side view corresponding to FIG. 22A. Sensor 102 includes a 2048 element CCD chip, having a responsiveness of 10 MHz, 6 v/(lux sec) peak at n=550 nm, and a dynamic range of 1600 (>1.2 Volt). Sensor 102 also includes a Selfoc® lens array from NSG America, Inc., 28 Worlds's Fair Drive, Somerset, N.J. 08873. The lens array includes 2 rows, a total conjugate of 32 mm, a wavelength: 570 nm, and a depth of focus:±0.45 mm. Sensor 102 also includes four banks of six lamps. Sensor 102 generates a signal indicating a total number of illuminated pixels.

In an alternate embodiment of the present invention, sensor 102 generates a signal indicating a number of contiguous illuminated pixels, or unlit pixels, depending on a jumper-implemented selection.

Each of sensors 101 and 178 has the same hardware structure as sensor 102.

Thus, a presently preferred copy machine has a high accuracy sheet registration system for precise placement of images on each copy sheet. The copy machine includes sensors with charge coupled devices (CCDS) that detect the sheet positions in two dimensions within the machine, and detect sheet arrival times at various positions with the machine. Using this detected information, the copy machine employs a multi-stage process to bring the sheet into contact with a color image moving on a photoreceptor belt, in synchronism with the position and speed of the image on the belt. The copy machine also monitors its own condition and makes predictions about needed preventive maintenance, to instruct personnel to service the machine before the machine fails.

Another alternate embodiment of the invention employs a multipass color rendering system, in which sheet registration in later passes is critical.

Additional advantages and modifications will readily occur to those skilled in the art. The invention in its broader aspects is therefore not limited to the specific details, representative apparatus, and illustrative examples shown and described. Accordingly, departures may be made from such details without departing from the spirit or the scope of Applicants' general inventive concept. The invention is defined in the following claims.

What is claimed is:

1. In a system including a moving substrate for holding an image, and a path to the substrate, a method comprising the steps, performed for each of a plurality of sheets, of:

sending the sheet into the path;

adjusting a position of the sheet by applying a first force to the sheet from a first position along the path; and applying a second torque-limited force to the sheet from a second position along the path, the second torque-limited force being a function of speeds of the substrate and the sheet.

2. The method of claim 1 wherein the system includes a first sensor that detects the sheet in the path to generate a first signal, and a second sensor that detects the sheet in the path to generate a second signal, and applying the first force includes applying the first force depending on first signal, and applying the second force includes applying the second force depending on second signal.

3. The method of claim 2 wherein applying the second force includes applying the second force depending on a sheet type.

4. The method of claim 2 wherein the system further includes a first processor executing instructions of a first random access memory, a second processor executing instructions of a second random access memory, and the method further includes sending a third signal from the first processor to the second processor, the third signal indicating a sheet type; and applying the second force includes generating a motor control signal in the second processor.

5. The method of claim 1 wherein system includes a first roller at the first position and a second roller at the first position, and applying the first force includes driving the first roller at a first speed; and driving the second roller at a speed different from the first speed.

6. The method of claim 1 wherein the system further includes a revolving member configured to propel the sheet along the path, the method further including applying the first force from the member to the sheet; and ceasing to apply the first force at a time when the member has completed a substantially integer number of revolutions.

7. The method of claim 6 wherein the integer number is 1.

8. The method of claim 1 wherein the system further includes a revolving member configured to propel the sheet along the path, the method further including sending a second sheet into the path;

initially contacting the first sheet at a position along a perimeter of the revolving member; and after the first sheet ceases contacting the revolving member, applying a drive force to the revolving member such that the second sheet initially contacts the revolving member at a second position, the second position having a predetermined displacement relative to the first position.

9. The method of claim 8 wherein the predetermined displacement is not equal to 0.

10. The method of claim 8 wherein the predetermined displacement is no greater than 5 degrees of revolution of the member.

11. The method of claim 1 further including indicating a jam condition by monitoring the presence of sheets in the path, the indicating step being performed in synchronism with the adjusting step.

12. The method of claim 1 wherein the system further includes a first member configured to propel a sheet along the path, a second member coupled to propel the first member, and a third member coupled to propel the second member, and the method further includes maintaining a ratio of a number of revolutions of the second member to a number of revolutions of the third member to be an even number.

13. The method of claim 1 further including sending a reference sheet into the path;

detecting the reference sheet at a first time in the path; and detecting the reference sheet at a second time in the path; wherein the step of applying the second force is responsive to a difference between the first and second times.

14. The method of claim 1 wherein the system further includes a moving member configured to propel a sheet along the path, and a generator that generates signals in accordance with a movement of the member, the method further comprising:

counting a number of signals from the generator; and determining a time between an event and one of the signals counted in the counting step, wherein the step of applying the second force is responsive to the number of signals counted in the counting step and the time determined in the determining step.

15. A system comprising:

a movable substrate for holding an image;

a path to the substrate;

a first adjuster that adjusts a position of a sheet by applying a first force to the sheet from a first position along the path; and a second adjuster that adjust the sheet by applying a second torque-limited force to the sheet from a second position along the path, the second torque-limited force being a function of speeds of the substrate and the sheet.

16. The system of claim 15 further including a first sensor that detects the sheet in the path to generate a first signal;

a second sensor that detects the sheet in the path to generate a second signal; wherein the first adjuster is responsive to the first signal, and the second adjuster is responsive to the second signal.

17. The system of claim 16 further including a third signal indicating a sheet type, and the second adjuster is responsive to the third signal.

18. The system of claim 16 further including a first processor that executes instructions of a first random access memory; a second processor that executes instructions of a second random access memory; and a third signal in the first processor, the third signal indicating a sheet type; wherein the second processor generates a motor control signal in response to the third signal.

19. The system of claim 15 further including a first roller at the first position;

a second roller at the first position, wherein the first adjuster drives the first roller at a first speed, and drives the second roller at a speed different from the first speed.

20. The system of claim 15 further including a revolving member configured to propel a sheet along the path, wherein the first adjuster applies the first force from the member to the sheet, and ceases to apply the first force at a time when the member has completed a substantially integer number of revolutions.

21. The system of claim 20 wherein the integer number is 1.

22. The system of claim 15 further including a revolving member configured to propel the sheet along the path, the revolving member acting to initially contact the first sheet at a position along a perimeter of the revolving member, wherein the first adjuster acts to a drive apply force to the revolving member such that a second sheet initially contacts the revolving member at a second position, the second position having a predetermined displacement relative to the first position.

23. The system of claim 22 wherein the predetermined displacement is not equal to 0.

24. The system of claim 22 wherein the predetermined displacement is no greater than 5 degrees of revolution of the member.

25. The system of claim 22 wherein the predetermined displacement is no greater than 1 degree of revolution of the member.

26. The system of claim 15 further including a first member configured to propel a sheet along the path;

a second member coupled to propel the first member; and a third member coupled to propel the second member, wherein, during operation, a ratio of a number of revolutions of the second member to the number of revolutions of the third member is an even number.

27. The system of claim 15 further including a detector that generates a first signal in response to detection of a reference sheet at a first location in the path, and a second signal in response to detection of the reference sheet at a second location in the path, wherein the second adjuster is responsive to an interval between the first and second signals.

28. The system of claim 15 further including a movable member configured to propel a sheet along the path, a generator that generates signals in accordance with a movement of the member;

a counter configured to count in response to signals from the generator;

a timer that determines a time between an event and one of the signals from the generator wherein the second adjuster is responsive to the counter and timer.

29. In a system including a movable substrate for holding an image, and a path to the substrate, a registration system comprising:

means for sending a sheet into a path;

means for adjusting a position of the sheet by applying a first force to the sheet from a first position along the path; and means for adjusting a speed of the sheet by applying a second torque-limited force to the sheet from a second position along the path, the second torque-limited force being a function of speeds of the substrate and the sheet.

30. In a system including a moving substrate for holding an image, and a path to the substrate, first actuator in the path, a second actuator in the path, and a third actuator in the path, a method comprising:

sending a first sheet into the path;

sending a second sheet into the path;

adjusting a position of the first sheet by applying a first force from the first actuator while applying a force, different from the first force, from the second actuator; and adjusting a position of the second sheet by applying a second force from the first actuator while applying a force, different from the second force, from the third actuator.

31. The method of claim 30 further including the step of driving the second and third actuators from a common motor.

32. A system comprising:

a movable substrate for holding an image;

a path to the substrate;

a first actuator in the path;

a second actuator in the path;

a third actuator in the path, the first, second, and third actuators defining an orientation transverse to the direction of the path; and an adjuster configured to a position of a first sheet by applying a first force from a first actuator while applying a force, different from the first force, from the second actuator, and to adjust a position of a second sheet by applying a second force from the first actuator while applying a force, different from the second force, from the third actuator.

33. The system of claim 32 wherein the first, second and third actuators define an orientation perpendicular to the direction of the path.

34. The system of claim 32 further including a motor for driving the second and third.

35. In a system including a movable substrate for holding an image, and a path to the substrate, first actuator in the path, a second actuator in the path, and a third actuator in the path, a registration system comprising:

means for sending a first sheet into the path;

means for sending a second sheet into the path;

means for adjusting a position of the first sheet by applying a first force from the first actuator while applying a force, different from the first force, from the second actuator; and means for adjusting a position of the second sheet by applying a second force from the first actuator while applying a force, different from the second force, from the third actuator.

36. The system of claim 35 further including a motor for driving the second and third actuators.

* * * * *